US007385125B2

(12) United States Patent
Motsenbocker

(10) Patent No.: US 7,385,125 B2
(45) Date of Patent: Jun. 10, 2008

(54) ELECTRIC STRING INSTRUMENTS AND STRING INSTRUMENT SYSTEMS

(76) Inventor: Marvin Motsenbocker, 17 Wallace Farms La., Fredericksburg, VA (US) 22406

( * ) Notice: Subject to any disclaimer, the term of this patent is extended or adjusted under 35 U.S.C. 154(b) by 79 days.

(21) Appl. No.: 11/384,449

(22) Filed: Mar. 21, 2006

(65) Prior Publication Data

US 2006/0213358 A1 Sep. 28, 2006

Related U.S. Application Data

(60) Provisional application No. 60/704,915, filed on Aug. 3, 2005, provisional application No. 60/664,368, filed on Mar. 23, 2005.

(51) Int. Cl.
*G10D 3/00* (2006.01)

(52) U.S. Cl. ..... 84/292; 84/291; 84/307; 84/309; 84/7; 84/10; 84/11

(58) Field of Classification Search ..... 84/730, 84/731, 7–11, 173, 267, 280, 281, 290–296, 84/725, 726, 723, 327, 329, 402–405, 453; D17/14, 18–20, 24, 99
See application file for complete search history.

(56) References Cited

U.S. PATENT DOCUMENTS 3,552,255 A * 1/1971 Kaston ..... 84/310
3,743,751 A * 7/1973 Ibanez ..... 84/741
3,833,751 A * 9/1974 Chapman ..... 84/726
3,974,732 A * 8/1976 Kester, Jr. ..... 84/421
4,143,575 A * 3/1979 Oliver ..... 84/726
4,206,678 A * 6/1980 Espinos Guerrero ..... 84/267
4,232,582 A * 11/1980 Diamond ..... 84/267
4,242,938 A * 1/1981 van Zalinge ..... 84/731
4,567,805 A * 2/1986 Clevinger ..... 84/731
4,630,520 A 12/1986 Bonanno
4,632,002 A * 12/1986 Clevinger ..... 84/731
4,635,523 A * 1/1987 Merchant ..... 84/307
5,033,353 A * 7/1991 Fala et al. ..... 84/72
5,069,103 A * 12/1991 Healy ..... 84/327
5,105,711 A * 4/1992 Barnard ..... 84/744
5,117,730 A * 6/1992 Yamauchi ..... 84/723
5,123,326 A * 6/1992 Clevinger ..... 84/743
5,270,475 A * 12/1993 Weiss et al. ..... 84/603
5,537,906 A 7/1996 Steinberger
5,817,961 A * 10/1998 Beck ..... 84/327
5,824,924 A * 10/1998 Agostino ..... 84/291
6,018,120 A 1/2000 Steinberger
6,255,565 B1 7/2001 Tamura
6,441,282 B2 * 8/2002 Tamura ..... 84/307
6,664,461 B2 * 12/2003 Tamura ..... 84/743
6,791,022 B2 9/2004 Green (Continued)

*Primary Examiner*—Lincoln Donovan
*Assistant Examiner*—Christopher Uhlir

(57) ABSTRACT

Marching band string instruments and wearable string instruments are described that include a stiff waist band to prevent excessive side to side movement during use, while providing easy doff and don of the string instrument. String instruments also are provided with adjustable chest braces to allow accommodation for different player sizes and for minimization of back strain when playing the electric string instrument for extended time periods. Electric string instruments optionally have soft material interposed between bridge feet and a string instrument body, to allow a more resonant sound detection from a pickup located between the bridge feet and the body. Other advances include generation of a stereo signal from bridge vibrations, and electronic processing of sound that enhances the electric string instrument playing and learning experience.

22 Claims, 7 Drawing Sheets

U.S. PATENT DOCUMENTS

| | | | | |
|---|---|---|---|---|
| 6,803,510 | B2 | 10/2004 | Van Dusen | |
| 2002/0056358 | A1* | 5/2002 | Ludwig | 84/738 |
| 2003/0015081 | A1* | 1/2003 | Lehoux | 84/327 |
| 2003/0094094 | A1* | 5/2003 | Nakaya | 84/736 |
| 2004/0255762 | A1 | 12/2004 | Takabayashi | |
| 2005/0011342 | A1* | 1/2005 | Fishman | 84/730 |
| 2006/0156896 | A1* | 7/2006 | Perkins | 84/327 |

* cited by examiner

3A

3B

3C

3D

ELECTRIC STRING INSTRUMENTS AND STRING INSTRUMENT SYSTEMS

REFERENCE TO RELATED APPLICATIONS

This application receives priority from U.S. No. 60/664,368 filed Mar. 23, 2005 and to U.S. Pat. No. 60/704,915 filed Aug. 3, 2005, both of which are entitled "Electric Cello and Cello Systems" and name Marvin Motsenbocker as inventor.

FIELD OF THE INVENTION

The invention relates to electric musical instruments and more particularly to electric string instruments.

BACKGROUND

Cellists and other string instrument players often take the limitations of their instrument for granted. One such limitation is low sound volume, due to inefficiency of energy conversion from mechanical bowing into sound energy from a resonating cello chamber. To alleviate this problem, musicians often group multiple cellos together within a string section of an orchestra to balance off a much smaller number of individual wind instruments or brass instruments. Compared to a wind or brass instrument a cello is wimpy.

Another problem for many is the large size of the cello, making transportation difficult for small, young players. Yet another is the fact that most cellos are played by sandwiching the instrument between the legs to keep the cello steady. Those who wear a short dress or skirt may find this very uncomfortable, or worse, which further limits usability of this instrument. Still another limitation is that most cellos cannot be played while walking or marching, which inhibits use in a marching band or while sauntering around a house or restaurant.

Recent developments in electric cellos alleviate the wimpy sound problem. An electric cello produces an electric signal output that may feed headphones, or that can be amplified and output to a speaker system. See for example the Silent Cello™ from Yamaha, cellos from NS Research, Jensen, and U.S. Pat. Nos. 6,255,565 and 36,664,461. Virtually all of these cellos are held and played in the traditional manner. A few are mounted on posts above the floor and the NS Design offers a shoulder harness with a very small, 12 inch wide inflexible stomach brace that does not reasonably prevent movement sideways. Many electric cellos have strings that extend far (eg. more than 6 inches, or even more than 9 inches) below the bridge, in a throwback to the old style. Unfortunately, many or most electric cellos fail to utilize fully the technology available but use big bridges mounted on solid supports and may even use old style tuning pegs.

Some electric cellos rely on digital electronics to recreate a cello like sound and use a separate, isolated pickup for each string, but tend to neglect the natural rich sound created by the bridge between the resonating chamber and the strings. Also sometimes ignored is the inter string energy transfer that occurs when vibration energy of a note from one string activates an open string that shares a harmonic or sub-harmonic relationship with the note. Such subtle interactions that give the cello its characteristic sound can be eliminated when individual isolated pickups are used for individual strings.

Developments in this area may be found in U.S. Pat. No. 6,018,120, which describes placement of a piezo electric crystal under the bass side of the bridge foot, but which still relies on a large resonating chamber; and U.S. Pat. No. 2004/0129127 A1, which purports to describe a number of "improvements" to the violin family, but which sound a little fantastic on the surface, and do not seem to be backed up with any significant experimental results. Also see U.S. Pat. Nos. 2002/0157523 A1, 4,389,917 and 6,803,510, which purport to present improvements to bridges and sensors located at the bridge. Electric cellos and basses are known that are held by floor stands, as seen for example in www.vectorinstruments.com/cellos/cellette.html.

Despite numerous advances in guitar and other stringed instruments over the last 75 years, many electric cellos use old technology and even maintain the unnecessary limitation of a large body, forcing the use of thumb positions. While such quaint limiting features may appeal to a small group of traditional cello players, a much larger number of would be cellists simply pass on to the more modern, more convenient and more adaptable guitar. Accordingly, cello playing is much less popular than it should be and cello music is greatly eclipsed by other instruments such as the guitar and electronic keyboards.

Other stringed instruments have related problems. For example, the electric bass guitar is considered too large by some people, and is not easily played while marching outside. This stringed instrument also is not easily bowed. A support that allows easy attachment to a player and that allows stable placement while walking around in a playing position would be an advantage and provide new opportunities for musical expression, particularly in athletic venues such as marching bands at sporting events.

SUMMARY OF THE INVENTION

Embodiments provide more convenient, easier to play stringed instruments to entice others into learning cello and other bowed stringed instruments such as the bass.

An embodiment provides a wearable cello, comprising a fingerboard, a base extending away from the user, and a stiff waist mount with a left end and a right end attached to the base, wherein the stiff mount is sized and positioned to cover at least the front of the wearer's waist with the left and right ends extending laterally. The wearable cello may have a stiff mount that is flexible enough so that a user can move the left and right ends apart by at least a noticeable distance such as 1 inch by moderate hand pressure. The stiff mount may envelope at least a 170 degrees radius, and more desirably extends straight along (and preferably curved in slightly) the user's left and right sides. The wearable cello further may comprise at least one speaker, an electric power supply and an amplifier, to allow amplification of sound from the cello within the cello. The wearable cello may comprise a speaker on a left side and a speaker on the right side, and/or a speaker in the end facing away from the player's head.

The cello or other stringed instrument may comprise a sound reference such as a 220 hertz or 440 hertz sine wave and/or square wave generator that may be activated manually or automatically to allow string tuning. The stringed instrument may comprise a sound detector such as a frequency detector component that indicates when a played string is out of tune. The instrument may comprise a tension device that tends to maintain constant string tension despite large changes in temperature. In yet another embodiment an instrument comprises a tension monitor that determines when the tension on one or more strings has changed, indicating a change in tuning. In a desirable embodiment, tension monitoring is coupled to automated tension adjustment for automated tuning. A circuit may be used that first checks to make sure that a string is not being played (by lack of sound output) and then adjusts string tension as needed.

The wearable cello may comprise a chest brace positioned below the fingerboard and extending along the chest towards the user's head, away from the base. The chest brace length may be adjustable to allow for different sized cello players. The wearable cello may comprise a fingerboard and one or more piezoelectric sensors positioned between at, near or between one or more optional bridge feet and a supporting body. The wearable cello may comprise two or more humbucker type vibrating string sensors, positioned with their coil center axes non parallel to each other to accommodate curvature of the fingerboard.

In another embodiment, a wearable cello is provided that comprises a fingerboard, a base extending away from the user, and a chest brace positioned within its long axis below and parallel to the fingerboard with a strap end towards the user shoulder, away from the base, wherein the chest brace long axis is adjustable to allow for different sized cello players. The wearable cello may have a chest brace that comprises a slide mechanism that allows manual length adjustment by a sliding action. The chest brace may be removably connected to the cello by a connecter that provides chest brace adjustment via movement of the component attachment to the cello base.

Another embodiment provides an electric cello, comprising a fingerboard, a bridge with two feet and a body that holds up the bridge, further comprising soft material interposed between at least one of the bridge feet and the body, the soft material having a durometer of less than 50 and preferably less than 35 or even less than 30. The soft material preferably is at least 1/16 inch thick (before compression), more preferably at least 1/8 inch thick and yet more preferably at least 3/16 inch thick. Two 1/8 inch (before compression by the bridge) pads sandwiched and positioned under each bridge foot (with piezo sensor between bridge foot and pads) worked well. The electric cello may comprise one or more piezo electric sensors located under at least one bridge foot and either above or below the soft material. Soft material may be positioned both above and below at least one piezo electric sensor. In an embodiment, a more desirable sound is produced by positioning a single sensor under the left bridge foot and over a soft low durometer (e.g. less than 40, 35, 30, 25 or even less than 20 durometer) cushion, and placing the right bridge foot over a higher durometer material than that of the left foot, for example a material having a durometer rating of more than 45 or even on a solid material such as wood, fiberglass, plastic or metal. This allows vibrational movement of the bridge to transfer energy onto the sensor via a rocking motion and replicates some aspects of natural sound.

An electric cello may comprise 4 or more strings positioned over a fingerboard and at least 3 magnetic pickup transducers, wherein the magnetic pickup transducers comprise a rod of at least one of paramagnetic metal, magnetic material, and ferromagnetic material, the material surrounded by coiled wire, with each of the magnetic pickup transducers in a different plane of the fingerboard. Each string may have a magnetic pickup transducer located with the rod under the string. Each of the at least 3 magnetic pickups may be paired with an additional magnetic pickup in the same plane and connected in a humbucking configuration to minimize pickup of extraneous noise. Each magnetic pickup may be electrically connected in an adjustable input circuit that allows adjustment of the sensitivity of the pickup to correct for differences in string positioning. At least one member of each pair of magnetic pickups may be electrically connected in an adjustable input circuit that compensates for differences in thickness or composition of the string that affects magnetic fields.

Another embodiment provides an electric stringed instrument with automated tonal selection, comprising one or more adjustable strings, one or more sensors to detect string vibration, one or more A-D converters to converted detected sound into digital signals, one or more computers to process and compare the digital signals with desirable on-key signals, and an output to an audio transducer to generate audible sound. The stringed instrument computer(s) may utilize a fourier transform algorithm to generate digital signals corresponding to detected notes.

Another embodiment is a cello having a fingerboard surface and neck surface (behind the fingerboard) that both comprise graphite to allow a smooth, durable and lower friction operation. Desirably, the surface is made by layering a polymeric resin such as polyester or epoxy or urethane with added graphite powder onto a body surface of the desired shape. These regions and/or other regions may be coated also with a sparkle flake finish, to allow higher visibility while playing or marching in the sunlight.

Yet another embodiment is a marching band bass having (preferably) 4 or even 5 strings. The four strings are tuned as electric bass guitar (G D A E) and the vibrating string length (e.g. between finger nut and bridge, or other point of attachment) preferably is 30 inches (short electric bass size).

Other embodiments and combinations of embodiments are intended and will be appreciated by a skilled reader.

DETAILED DESCRIPTION OF DESIRABLE EMBODIMENTS

The term "stringed instrument" as used herein refers to a musical instrument having one or more strings that may be plucked and or bowed to produce vibrations of different notes. The notes may be selected by pressing with one or more fingers, usually over a fingerboard that may have frets. The term "cello" as used herein refers to a bowed string instrument having a bowed string region (location where bow contacts strings, near the bridge) and a fingered string region wherein the fingered string region is closer to the user's head than the bowed portion. A cello may be held between the legs in traditional fashion, attached to the floor or to a stand, held to the user's torso with a sling, strap or belt, or otherwise positioned at a relatively fixed location with respect to a user, to allow note selection by fingering.

In an embodiment, the term "soprano cello" is defined to mean a 4 string cello having an E string above the A string and missing a lower C string or may include the lower C string as a 5 string cello. The term "alto cello" as defined herein means a 4 string cello having an F string below the C string and missing the A string, or may include the A string as a 5 string cello. A six string cello may include for example, both added E and F strings.

The term "marching cello size" refers to a cello with a fingerboard that is between 0.5 to 5 inches longer and particularly 1 to 4 inches longer than the 23.5 inch standard full length. The width desirably may be proportionally wider as well. An embodiment provides a bass stringed instrument for marching band use having larger sizes and longer string lengths suited for electric bass notes. A preferred embodiment has a finger nut to bridge length of 30 inches (in an embodiment, plus or minus 1 inch) and can use electric bass guitar strings which are designed for the short electric bass. Another embodiment is of regular electric bass guitar size and uses strings suitable for that instrument, and preferably flat wound strings.

A variety of configurations, circuits, pickups, processing, and tuning devices and systems were discovered, as described in more detail below.

Instrument Configuration

In an embodiment the cello comprises a) a fingerboard with b) strings held in position over the fingerboard, c) one or more transducers that generate electrical signals in response to movement of the strings that typically are plucked (with finger/pick) or bowed, and d) either a large body held between the legs or a mount such as a shoulder mount, floor mount or belt mount to allow a fixed position with respect to the user while playing.

Figure 1:
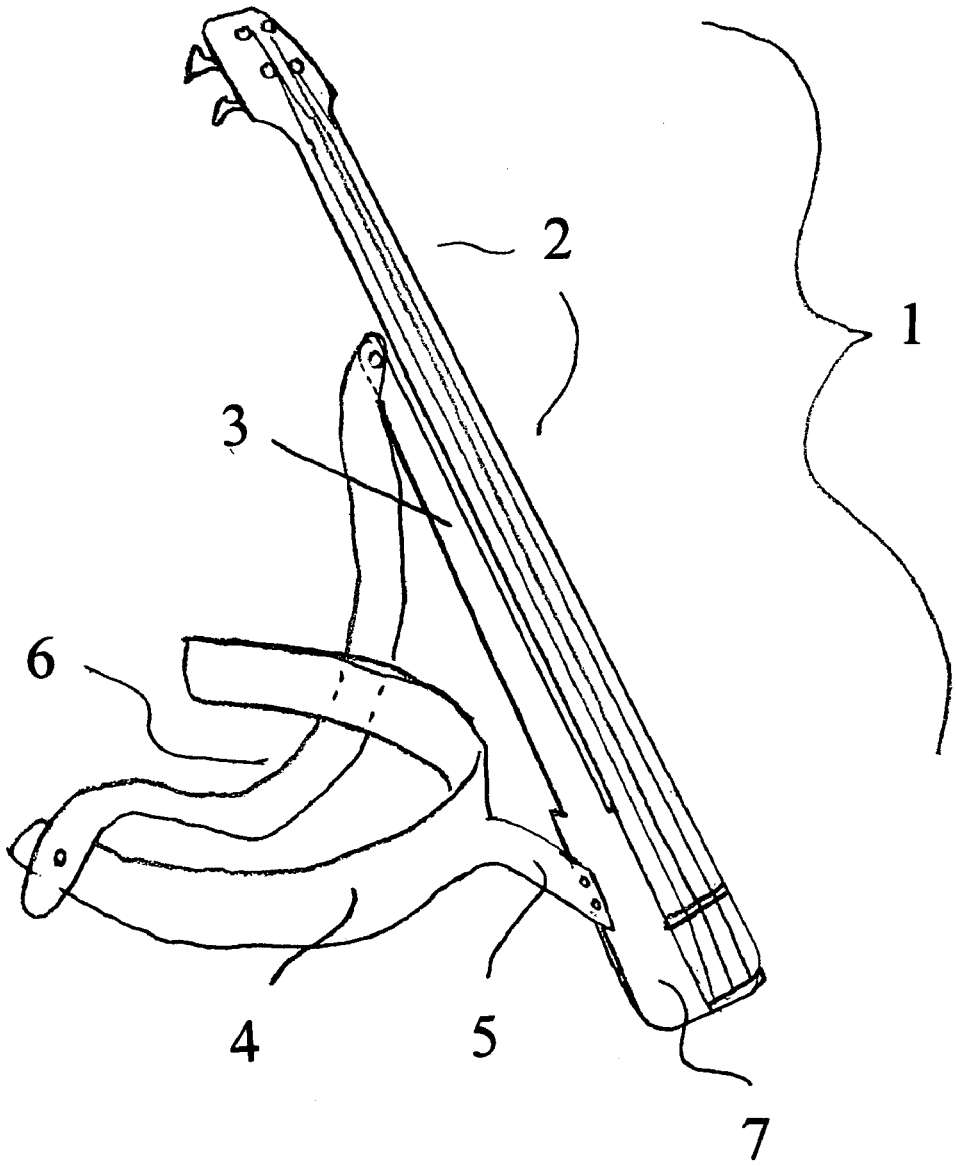
FIG. 1 shows an outline of a representative cello according to an embodiment wherein the cello stands up (sits up in a natural position) when not worn.

In a most desirable embodiment shown in FIG. 1, cello 1 comprises a long fingerboard 2 with an elongated chest extension brace 3 behind it, and a firm waist mount 4. In an embodiment, the waist mount is rigid. In an embodiment the waist mount is stiff (flexible, having its own structure when no pressure applied, and not loopy as a regular belt) and is connected to the cello body with stiff coupling 5 as shown in this Figure. The waist mount desirably is connected to the chest extension via strap 6. This allows the cello, in a most desirable embodiment, to sit upright on the floor in a natural playing angle when dismounted as shown in FIG. 1. The elongated chest extension can be parallel to the fingerboard 2, but studies carried out showed that an extension with a smaller space near the top than at the bottom often is more comfortable. Desirably, extension brace 3 is coupled to lower cavity 7, which contains a power supply and electronic circuit(s). Desirably, the top of chest brace 3 may be offset centered by at least 0.25 inches, or at least 0.5 inches to the left of fingerboard 2 (with respect to the wearer looking forward) so that the cello top comfortably extends over the user's left shoulder on the left side of the neck with the chest brace touching the left chest and/or middle of the chest. For right handed players the chest brace vertical extension may be offset to the other side.

In an embodiment the instrument configuration includes one, two or more speakers in the cello body such as, for example in lower cavity 7 in FIG. 1. In yet another embodiment, a speaker and/or amplifier is reversibly attached and preferably behind the lower bottom of extension brace 3, and/or behind lower cavity 7, or even on the belt. Most preferably speakers are placed on the left and right sides of a waist band and facing away from the wearer's left and right sides. A bridge (10) may be located near the bottom as shown here. Three strings may be seen in this Figure.

Embodiments are intended for electric stringed instruments generally. For example, although tuning systems are described in the context of their use in a cello, these similarly are intended for use in other stringed instruments as well such as electric violin, violin, bass, bass guitar, regular guitar and ukelele.

The Fingerboard

The cello has at least one fingerboard with strings positioned over it so that pressing a string onto a fingerboard surface shortens the vibration length of the string and alters pitch of a note. The fingerboard may be, for example, ebony, another hardwood, a graphite composite, a metal or polymer. The string may be bowed, plucked, moved by electromechanical action, or may otherwise participate in an electronic circuit with the fingerboard to produce a signal change that may be sensed to deliver a note. In an embodiment the fingerboard, which may have frets, is reversibly attached to the cello body by for example, screws, bolts, snaps, magnets, or Velcro. In an embodiment for marching band use, the fingerboard is slightly larger than full size (e.g. 3% to 50% larger, preferably 5% to 30% larger, more preferably 10% to 20% larger in both length and width). A cello was built with regular full size string length, but having a fingerboard 15% longer and wider, and was more easy to play.

A manufacturing method is provided wherein a solid base of wood or plastic, such as Douglas fir, pine, oak, fiberglass, filled or unfilled epoxy, filled or unfilled polyester or the like is covered with one or more layers of graphite-resin mixture. For example, a wood form of suitable size may be shaped into a fingerboard section and possibly one or more other sections, and then coated with resin having between 1-50%, 5-35%, 7-25% or more preferably 10-20% by weight graphite powder. The front and optionally the back of the fingerboard surface may be coated this way. In a particularly desirable embodiment a fingerboard surface similarly is coated with chemiluminescent and/or fluorescent material. Desirably a light colored wood (pearwood) or plastic is used for the fingerboard and optionally is dyed or colored white prior to coating. By shining light, especially ultraviolet light, onto the prepared fingerboard surface, the fingerboard may be seen in the dark. Other components may be painted differently, particularly with material that contains particles that reflect light, allowing use in the sun for marching bands, where a noticeable shiny surface is desired.

In an embodiment two or more fingerboards are provided as a kit or sold with a cello having alternative features to allow change from a fretless fingerboard to a fret containing fingerboard. Another embodiment allows change to a white, black, red, blue, green, yellow, other color, or multi colored fingerboard. In an embodiment the fingerboard has two or more colors, such as the lower octave one color and a higher (closer to the bridge) octave(s) a second color. One or more frets may be added at fifth intervals. In an embodiment, a fret fingerboard is used along with a lower string such as an F string below (physically to the outside of and parallel to) the C string, to allow deeper bass accompaniment to a marching band. In a preferred embodiment a fret is provided at exactly one harmonic (midway of the string length) for a reference point.

In an embodiment, the fingerboard is a traditional passive device having a surface upon which one or more strings are pressed to alter their effective vibration length. In another embodiment, however, that does not require a bowed sound, the fingerboard is electronically active, such that the surface has an electronic property that allows generation of an electronic signal without bowing the string and detection of string vibration. In the active fingerboard embodiment, contact of string with the fingerboard causes the generation or alteration of an electrical signal proportionate to the string length and/or to the location on the fingerboard. For example, an oscillator circuit(s) may be activated by detecting contact between fingerboard surface (and/or fret) with one or more strings. This embodiment is particularly desirable for finger practice and/or marching band use, where bowing of the string is not desired or is less practical. In an embodiment, a bow is not used, and the active fingerboard may be used for fingering practice. The same cello may be used with bowing and without bowing in an embodiment, by activation of a switch to select the mode.

In one active fingerboard embodiment, a voltage such as a DC voltage measurement or capacitance measurement along the fingerboard reveals finger positioning information. For example a system that has an electrically conductive fingerboard and that generates a series of nodes and/or frequencies along the fingerboard (typically along the long axis of the fingerboard) will allow detection of metal string contact with the fingerboard by completing a circuit (with the string and the fingerboard surface or surface portion participating) wherein touching the string to the fingerboard provides a fingerboard position dependent signal output.

This later embodiment may be implemented a number of ways. For example, each string can be wired into a high frequency circuit that is further connected to the fingerboard such that connecting a shorter portion of the string and/or connecting to a different portion of the fingerboard produces a different frequency output of the circuit. In an embodiment, each string is part of a radio frequency circuit of at least 1 MHz, preferably at least 10 MHz, more preferably at least 100 MHz. In an embodiment, the string corresponds to full wave, half wave, quarter wave, eighth wave or other sub-multiple of a radio frequency wave and contacting the string to the fingerboard alters the effective length of the string (as a wire, an inductor, a capacitor or even as an antenna) to the radio wave. Such alteration is detected directly (as part of the circuit) or indirectly to generate notes. In another embodiment, while this occurs with a fingering hand (typically the left hand) the right hand has other switches or controls to allow modulation of amplitude and/or pitch by touching finger(s) of the other hand to another part of the instrument.

In an embodiment, the fingerboard has frets and the surface region between each fret is associated with a different signal or circuit such that contacting a string (the string electrically connects in a circuit) to that surface region provides a signal indicative of the desired note to be played. In an embodiment each fret is electrically conductive and forms a circuit with a metal string when contacting that string. The circuit forms a note or modified sound upon contact between fret and string. In another embodiment additional information may be obtained simultaneously for determining loudness or another parameter. For example, capacitance or conductivity from a finger surface can be detected to modulate the loudness of the note to be played. In an embodiment, pressing harder results in a louder sound. The modulated increase may, for example, be effected by an increase or decrease in conductance, inductance, capacitance, and/or impedance.

A desirable embodiment provides a short bass guitar that optionally is bowable. In one such embodiment, a finger nut is used at the instrument top and a bridge is used at the bottom, that are 30 inches apart and accept 4 regular short bass guitar strings. The fingerboard optionally has frets on it. This embodiment provides electric bass guitar operation on a stable platform where preferably a stiff waist band and a chest extension allows stable attachment to the wearer's body. Such instrument can be worn while marching. Most desirably, the instrument may be plucked or even bowed, while marching, and may be used in combination with an amplifier and one or more speakers. In an experiment a regular 27 to 27.75 inch long vibrating string cello as described here was modified by adding 30 short bass strings and tuning for electric bass, with good sound quality results.

Bridge or Other String Holder

In an embodiment, the strings are held in place and immobilized beyond the distal end (away from the player's head) of the fingerboard via a bridge. Preferably the bridge comprises a stiff material such as a hardwood (e.g. maple) and may be pressed onto an underlying material by pressure from the strings, as normally used in a traditional cello. In an embodiment, a bridge is used that sits on top of a non-resonating cavity and bowed strings are tensioned on top of the bridge in a traditional manner. A bow may be used to vibrate one or more strings.

Alternatively, instead of a bridge, the strings may be immobilized at each end without a bridge in between. In a desirable embodiment, a bridge is used that is of smaller weight and size than a standard maple wood 4/4 size cello to allow greater absorption of vibration energy into the bridge. For example, the bridge mass and/or volume may be (either or both) less than 0.5, 0.25, 0.15, 0.1 or even less than 0.05 times the volume or weight of a regular Maplewood 4/4 cello bridge. In an embodiment the vibration energy from strings is transferred more readily to a piezoelectric transducer in contact with the smaller bridge compared to a regular bridge.

In an embodiment, improved sound was obtained by dimensioning the bridge (and optionally in combination with lesser downward string force and/or low durometer soft pad under the bridge legs) to have a good height to width ratio. The "height" in this regard means the average string height above the bridge feet. The "width" in this regard means the horizontal distance between the outer strings (maximum string separation distance parallel to the bridge feet surface). It was found that increasing the height to width ratio from less than 0.25 to between 0.5-0.66 provided a more resonating sound (sound that persists with a longer decay time). Desirably the height to width ratio is at least 0.3, more desirably at least 0.4, at least 0.5, 0.6 or at least 1.0. In an embodiment the ratio is between 0.4 to 2 and more desirably, between 0.4 to 1. In one working prototype, the bridge was about 2.1 to 2.25 inches wide and about 1.25 inches high. That bridge had a cut out space 1 inch wide and one half inch vertically in the bottom center, with a foot about one half inch horizontally (extending perpendicular to the strings) on each side. A similar bridge that was shorter gave less pleasing sound because of greater dampening. Similar bridges that were the same width but 0.5 to 1 inch higher gave superior sound. Desirably the bridge width at the bottom (feet) is narrower than the width at the bridge top, as exemplified by bridge 3 in FIG. 1 having feet 20 and 40 with a broader top 45.

In a desirable embodiment bridge 10 (see FIG. 2) is mounted on a softer surface compared with that of a traditional cello, to allow greater vibration in the bridge from string movement via strings located at positions 25. For example, bridge 10 may be mounted onto neoprene or rubber pads 50, optionally with a piezo electric sensor(s) 20 and 30 such as a sheet of piezo plastic between the bridge and neoprene. This figure shows a side view wherein the piezoelectric sensors 20 and 30 are thinner than the soft pads 50 (electrical connections to the piezoelectric sensors not shown). The pads may exist as one continuous sheet and/or may be a continuous part of the underlying structure. A desirable bridge is 2.6 inches high in the center, and typically is spaced above the cello body by 1/32 to 3/16 inch thick compressed pad. Bridges having heights that are within 0.5 inches of this are particularly desirable.

In an embodiment only one piezoelectric sensor is used, preferably on the thinner string side, and in another embodiment only one soft pad is used below the piezoelectric sensor. For example, piezoelectric sensor 30 with its own pad may used with no piezoelectric sensor and no pad on the other side. A rubber, closed cell urethane, open cell urethane, neoprene, soft wood, leather, spring, or other material that allows the bridge to vibrate while alleviating absorption of vibration energy, may be used in place of pad 50 to give a brighter sound. The bridge mass may be made smaller by choosing a lower density material for the bridge, but having a greater stiffness.

In another embodiment, the amount of string pressure normally applied to a bridge via tensioning of the strings on top of the bridge as in a regular 4/4 size cello is decreased to facilitate bridge vibration. Greater ability to vibrate can be provided by contacting the bridge on a soft surface and also by contacting on a slippery surface. This allows the bridge to vibrate more easily, and actuate a piezo or other detector in contact with the bridge. Additionally, less pressure down on the bridge can mean less resistance to bridge vibration. Desirably, the higher pitched strings (A, then D, or E then A) which exert higher tension than the lower strings are mounted over the bridge (if used) at a lower angle (more horizontally, with less angle down away from the bridge) than the lower strings, to maintain a more constant push down onto the left versus right sides of the bridge. This was found to give better sound for the lower strings. Preferably each string is set at a suitable angle to maintain a roughly (within 25%, preferably within 10%) equal downward force by each string on the bridge, when a bridge is used.

A traditional cello places much pressure on the bridge by virtue of the tail piece pulling the strings down over the bridge at an angle that can be measured. By decreasing this angle so that the string from the bridge to the tail piece end is more nearly parallel to the string traveling over the fingerboard, less pressure is exerted on the bridge. In an embodiment, at least 5% less, 10% less, 15% less, 25% less, 35% less, 40% less, 50% less, or even at least 75% less pressure is exerted (as measured in terms of force onto the bridge feet). Without wishing to be bound by any one theory of this embodiment of the invention, it is pointed out that a traditional cello requires significant vertical bridge pressure pushing the bridge down onto the cello body in order to form a co-extensive resonating body. However, an electric cello that does not utilize the same large chamber does not need such bridge pressure. A combination of a) smaller bridge size and mass; and b) soft, resilient base (such as rubber, polyurethane or neoprene under the bridge feet), to minimize conduction of vibration energy into the body of the cello is particularly desirable.

In another embodiment, a bridge is mounted on top of a resonating material that resonates over a wide frequency range in response to receiving vibration from the bridge. A materials engineer in the acoustics field will be familiar with materials and cavities that may be formed to achieve at least some resonance between (for example) 100 and 10,000 hertz. Placement of a bridge on top of such material or a small resonating chamber provides a natural (non-electronically based) fullness of sound due to a) modulation effects of different frequencies combining, such as from coupling between 2 or more strings, and b) time delay or echo effects from resonance that forms. Desirably such resonating materials or chambers have small volume of preferably less than 2 cubic feet, 1 cubic foot, 0.5 cubic foot, 0.2 cubic foot or even less than 0.1 cubic foot.

In yet another embodiment the bridge is attached to 1 or more springs (or related device) that provide a richer sound. Preferably at least one spring, oriented parallel to the strings, tugs on the bridge towards the bottom (away from the player's head). This may be at least partially balanced by one or more strings (also oriented parallel to the strings) that tugs on the bridge in the opposite direction. In a desirable embodiment, the springs tug at oblique angles to the strings, or even perpendicular to the strings, to allow greater interaction with side to side bridge vibration movement.

In an embodiment a magnet was glued to the bridge with the magnet's long axis perpendicular to the strings (parallel to the bridge flat surface) and a wire coil sleeve fixed to the cello base (not shown) so that the magnet was free to vibrate within the fixed coil sleeve. Feedback to the bridge was achieved by amplifying a piezo electric sensor driven output and passing the amplified current through the coil. In another embodiment, the coil is used as a pick up device. Preferably the coil output feeds a circuit with a low input impedance of preferably less than 10,000; 5,000; 2,000; or 1,000 ohms and more preferably between 1 and 250 ohms.

In another embodiment, a resonating chamber is simulated by providing a sound output device in contact with the bridge and electrically connected to generate and feed sound obtained from a transducer back into the bridge. In an embodiment such output device is driven with time delayed (echo) signals and/or modulation signals. One example of such sound output device is a plastic piezoelectric having a wide bandpass and which is located under the bridge. In an embodiment a sensor under one bridge foot is amplified, the signal optionally processed and then fed into a transducer under a second bridge foot. Such transducer may be in direct contact with the bridge, or may be sandwiched with a resonating material or other material such as a slice of wood. When using this embodiment, a positive feedback limiter or a low pass filter may be used to prevent squeals.

Optional Mount

In an embodiment, the cello body has movable or fixed arms that can be cradled and/or used between the legs, as exemplified in U.S. patents issued to Yamaha and as described and used by others previously. A preferred embodiment provides an electric cello that is worn on the torso and small enough to allow playing while standing or marching.

The preferred mount is a stiff, flexible or rigid band that is placed around at least part of the user's waist and that is attached to the bottom, distal (away from the user's head) end. The preferred mount (see top views of FIG. 3A-3D) is curved to contact the front and at least the left or right side of the user's body. The mount (see band 5 of the Figure top view), preferably is one to six inches wide (i.e. 1-6 inches vertically, like a belt), more preferably 1.5 to 4 inches wide and can be positioned around at least 90, 105, 120, 150, 180, 195 degrees or more of the player's waist, preferably centered at the front of the user. Desirably, at least a portion of the player's waist side is covered to minimize side movement while playing, as exemplified in FIGS. 3A, 3B, 3C and 3D. A portion preferably covers the user's left and right sides, and may be straight back, or slightly curved in, as shown as 51 in FIG. 3C. In a most desirable embodiment a mount is rigid or more preferably stiff, rigidly connected to the cello, and contacts a floor surface (as exemplified in FIG. 1) when dismounted, by a perimeter distance of at 12 inches, 14 inches, 16, inches 18 inches 20 inches or even at least 24 inches. Most preferably the mount has a perimeter distance of at least 14 inches. The mount shown in FIG. 1 worked well, and could have been made shorter.

Figure 3:
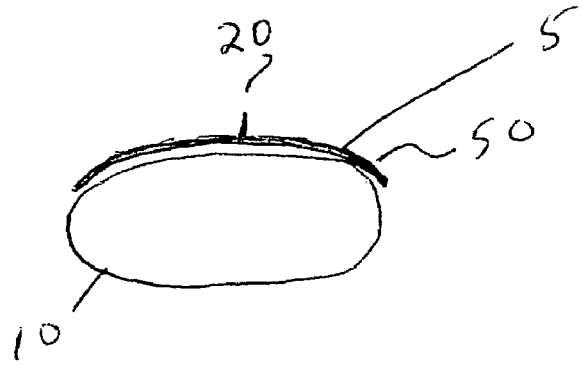
FIG. 3 shows representative waist mounts for a wearable cello according to an embodiment.
Figure 3:
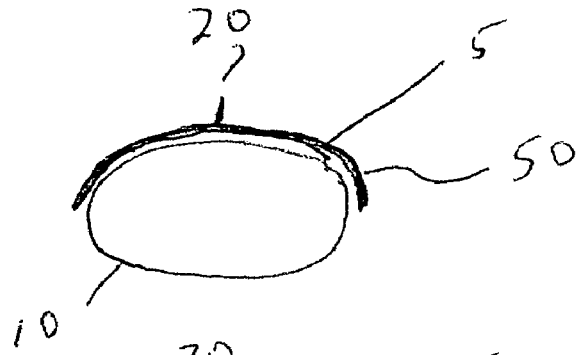
Figure 3:
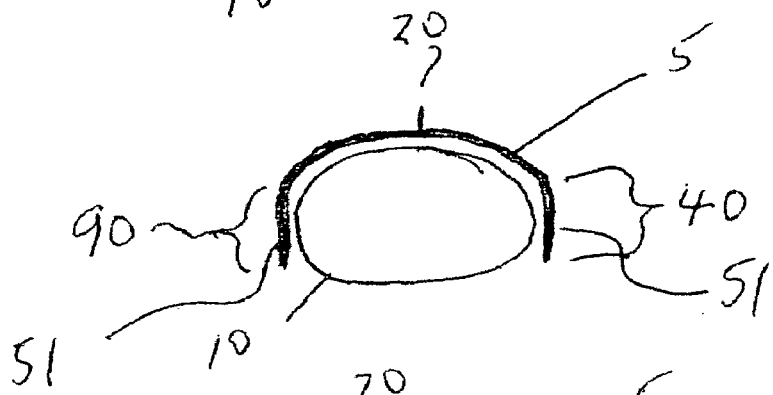
Figure 3:
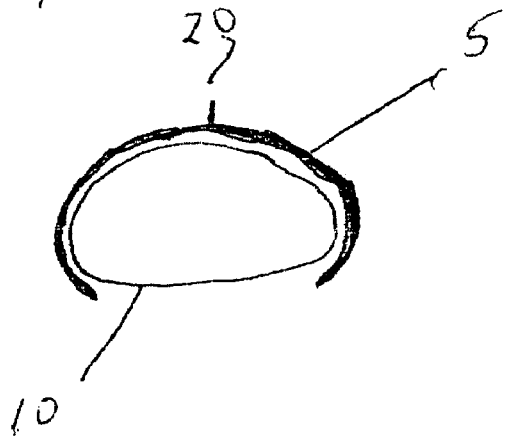

Oval shape 10 of FIG. 3 represents in top view the cross section of a user's waist/torso. Band 5 is shown with the front of the user facing up (to the page top), should cover at least most of the front (i.e. 120 degrees front circumference) of the waist as shown in FIG. 3A, but more preferably covers at least 150 degrees, more desirably 180 degrees (FIG. 3B) and most preferably has straight side extensions shown in FIG. 3C. In experiments, it was found that straight sides 51 as shown in FIG. 3C should bend inwards towards each other a little (desirably between 1 and 6 inches each, more desirably between 1.5-3 inches each) to fit snug on the player.

A mount may be rigid and cover at least the front 135 degrees part of the user's waist. More desirably, however, in an embodiment, the mount has enough flexibility so that two pounds of force placed at the middle of an extreme end with the center of the mount (normally positioned near the belly button) immobilized in a vise, acts to push that extreme end apart from the middle by at least 0.5 inch, 1 inch, and preferably at least 2 inches. In a more stiff embodiment 4 pounds of pressure (i.e. two pound on each end exerted from the center between them) are needed to push the ends apart by that distance. This flexibility allows desired snugness, which limits movement while playing. FIG. 3D shows an optional partial wrap around at the user's back.

After some experimentation, it was found that a band made from compressed cellulose (1/16 to 1/18 inch thick) wetted and formed in a curve, dried, and then laminated by adding one to five layers of 8-12 ounce biaxial glass cloth in epoxy on each side, worked well. Use of one layer of 12 ounce glass on each side worked okay but two layers gave a more durable waist band. Typically, this is made in elongated curved sheets, and then sliced with a saw into 2-4 inch (preferably 3 inch) wide ribbons. After slicing, the edges preferably are sealed with epoxy, paint or other material to limit moisture entry. In one trial, regular grey 1/8 inch thick PVC sheet was cut into 3 inch wide strips and heat treated to make into a curve approximating a waist size. Two such curved strips were laminated together with PVC cement to give a stiff waist band that could accept a cello directly or via a shoe. Other plastics can of course be used, as well as combinations of materials. In an embodiment an instrument is attached directly to a flexible belt. In another embodiment, a stiff waist band is closed at the back by a strap or other elongated closing mechanism.

In another embodiment the mount includes a more flexible belt around the waist. For example, a small stiff or inflexible surface (such as for example a 1 to 25 square inch plate or plastic surface) may be attached to a belt and be attached to the cello (such as via a metal rod or other support) in the front of the user's body. In another embodiment, a costume or other larger structure may be used, such as that worn with such great flair by Marston Smith, the great, innovative new age cellist. In another embodiment the mount may be very short or missing and a belt may be relied on to attach to a user's waist.

In a desirable embodiment, the band is flexible to allow movement for doffing and donning around a waist, but stiff, such as a flexible fiberglass in a U shape that can be sprung apart slightly to allow tensioning around the waist sides. Best results were obtained with a band of fiberglass 3 inches high that is sized to cover the front and sides of a user's waist (FIG. 3C), with the lower (distal) end of the cello attached at or near the middle of the band at position 20.

A desirable stiff waist band may have, for example, 1-8, 1-6 and preferably 2-4 layers of approximately (e.g. exactly) 6 ounce or 8 ounce glass cloth laminated in the shape of a "U" with side distance 40 between 1 to 14 inches long especially preferred. Experiments using epoxy and 8 ounce glass fiber over thin ca. 1/8 inch thick particle board showed that 3-4 layer of glass gave best results. A plastic such as PVC may be used. For example, two 1/8 inch thick 3 inch wide bent strips of PVC may be solvent welded together to form a flexible band that will keep its shape while worn on the waist with a cello mounted (preferably through an intervening shoe) on the front.

Most preferred was a band with a slight curvature (e.g. 5-30 degrees of the body radius on each side) inwards of the side distance 40, as this allowed snug placement on the body. The band may be assembled as 2 or more sections that can be snapped, bolted, velcroed, or otherwise connected. The band and its connection to the cello most preferably should be stiff enough to allow the cello to sit upright when placed on the floor, with the keyboard at a natural looking playing angle as depicted in FIG. 1. In an embodiment, the band on the user's left side (section 90 on FIG. 3*c*) is taller to allow more stable upright placement on the floor, when the cello is tilted at a normal playing angle. That is, the band is taller (more vertical) on the left side than on the right for greater balance when resting on the floor.

In an embodiment, the mount additionally has a flexible band such as a belt, (made from rubber, leather, plastic, fabric or other material) that connects two ends of the mount. A two inch wide leather belt was found to work best. Preferably this shoulder strap connects from the right side (position 50 for example) to (preferably the top of) a fixed or adjustable chest extension on the cello as described below. In another embodiment the mount is snapped, velcroed, buttoned or otherwise attached to a shirt, vest, coat or other worn clothing of the user.

Desirably the band at or near (preferably within 8, 6, 4, 3, 2, of 1 inch) its center at position 20 is attached to the cello at the lower half and preferably at 1 to 12 inches from the distal (bottom) end of the cello, away from the players head. The band at or near position 50 (i.e. on the side) preferably is connected to a chest extension or to the cello top by a strap, such as a leather or cloth strap, with the strap extending over a shoulder as for an electric guitar.

Figure 4:
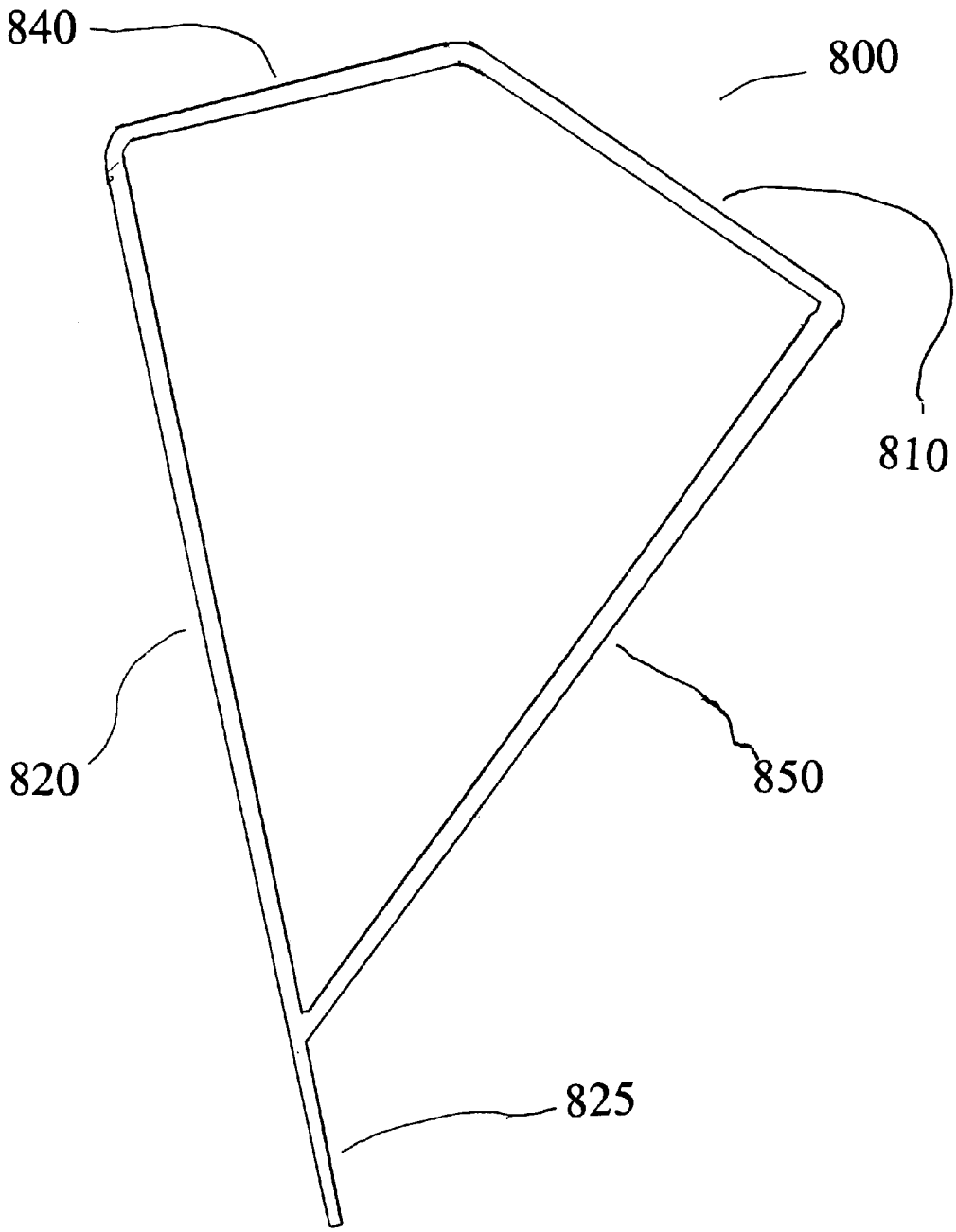
FIG. 4 shows a side view of an optional shoe that connects a cello to an optional waist mount.

Desirably, the mount further is attached to the cello body via an intervening spacer termed herein, the "shoe." A shoe may be as small as a wooden wedge spacer less than 3 inches deep that connects the cello at a preferred angle (with stringed top tilted to the wearer's right side, for example) to the mount. In a series of tests, $1/8^{th}$ inch thick aluminum strips 2 to 3 inches wide were bent into a shoe shape as depicted in FIG. 4. The side view of shoe 800 shown in FIG. 4 (3 inch deep aluminum in the z axis not seen) has side 810 that attaches (face to face) near or at the middle of a fiberglass mount. Side 820 attaches to the cello bottom face (facing away from the stringed top) via two or more bolts. The bottom protruding portion 825 of side 820 shown in FIG. 4, which is mounted towards the cello bottom, was made longer as needed to allow adjustable attachment further up towards the cello top. Side 840 was found most convenient to use for placing volume and switch controls for easy user access and side 850 faces the floor.

In an embodiment, batteries and an amplifier are placed within the shoe cavity, and the shoe further contains a jack on side 840 to connect a speaker. In another embodiment a speaker further is added on one or both open ends formed by sides 810, 820, 840 and 850. A ten watt amplifier, 5.5 inch diameter speaker, and twelve AA side metal hydride batteries were installed in a larger shoe having the same ratio of sides but large enough for a 5 inch speaker. This system gave strong sound with the speaker but caused strings and other parts to resonate at high levels. For marching band use, it is more preferred to use an outboard speaker that may be attached via an absorbent material (e.g. rubber or neoprene) or more likely simply attached to a different part of the player's body. In a particularly desirable embodiment, speakers are attached to either side of the waistband and face away from the wearer's left and right sides. In an embodiment a tubular speaker is inserted into a larger shoe. In a preferred embodiment, a 6 inch diameter 12-16 inch long circular tube is inserted into a shoe made from 3 inch wide aluminum and just big enough to hold the tube, and a 6 inch diameter speaker and amplifier/batteries also placed in this speaker cabinet.

For greater player comfort, a wedge was used to connect a shoe to the cello backside. In one most desirable embodiment, a wedge from 0 inches on one (lateral, extending down the cello long axis) side to 1 inch (lateral) thick on the other side was placed between 3 inch wide shoes and (ca. 2.5 inches varying) cello bottoms, to turn the cello string top to the players right side. A shoe (with or without added wedge) typically may be between 0 and 15 inches between the waist band and the cello, more preferably between 0 and 8 inches and yet more preferably between 1 inch and 9 inches. In another embodiment, no shoe is used and the cello is attached directly to a user's belt or to the mount.

Figure 5:
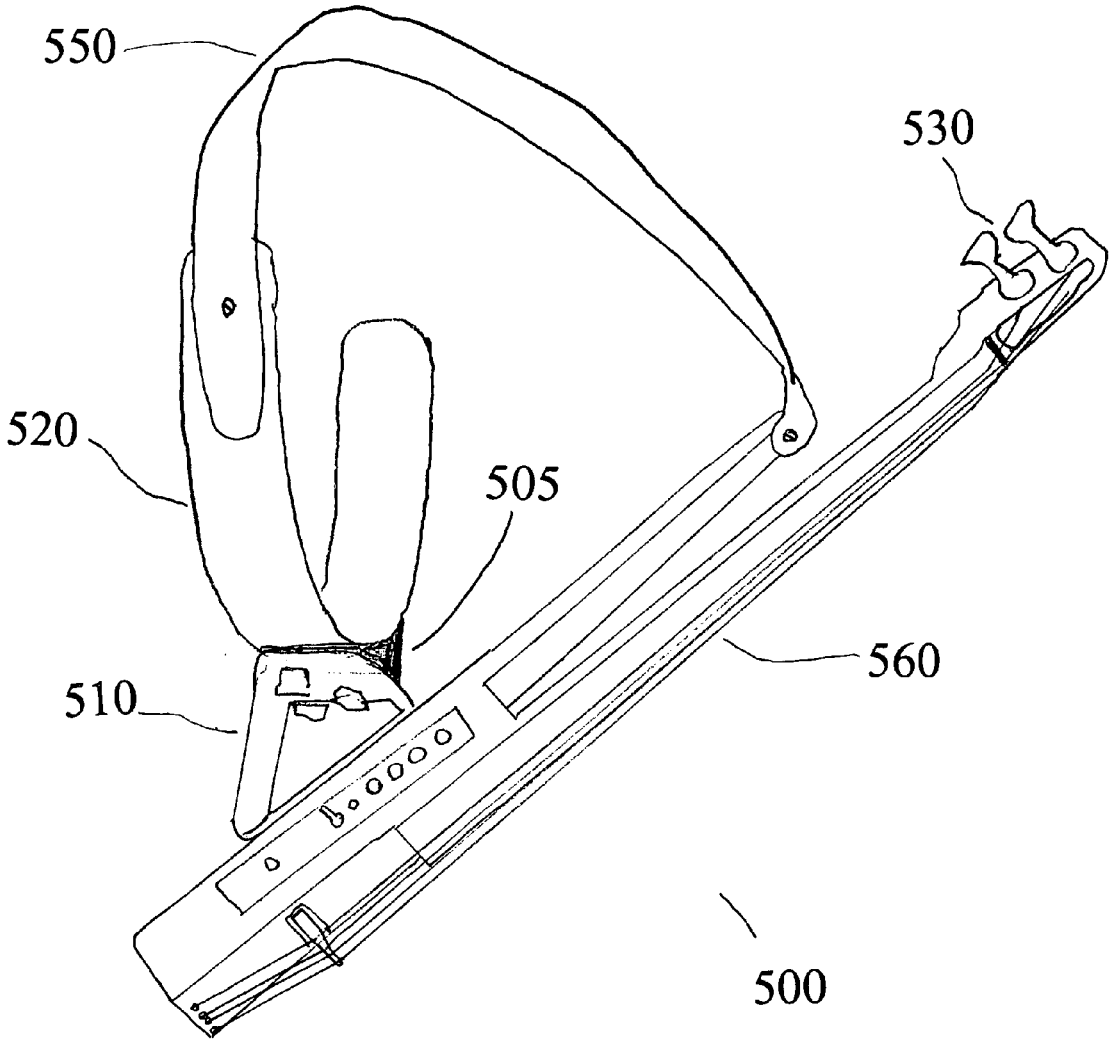
FIG. 5 shows an outline of a representative cello according to an embodiment having an open shoe that disassembles for easy storage.

FIG. 5 shows a desirable embodiment of an instrument 500 attached via adapter 505 (a wedge made of wood as shown here) and shoe 510 made of aluminum to stiff waist band 520. As seen in this Figure, tuners 530 (2 of 4 are visible) are mounted in hollow head region 540. Two T nuts (not seen) inside the cello body, four inches apart (desirably between 20 inches to 2 inches, more desirably between 12 inches to 3 inches apart) accept bolts (not seen) that fasten the cello body to aluminum shoe 510. Shoe 510 is made of ⅛ inch aluminum 2 inches wide that has been bended into the shape shown.

Chest extension brace 520 is not exactly parallel to the long body axis of cello 500 but has a top end (with strap 550 attached) that is between 0.5 to 2.5 inches and more preferably 0.75 to 1.5 inches) offset to the right side of fingerboard 560. While shoe 510 is aligned with the instrument long axis (represented by the axis of fingerboard 560), adapter wedge 505 tilts the fingerboard clockwise (looking down the long axis from the head end) by at least 5 degrees, more preferably at least 15 degrees and yet more preferably at least 30 degrees. It was found that attaching the adapter 505 and shoe 510 to the left side (about 0.5-6 inches left, preferably 1-3 inches left as viewed by the player wearing the instrument) of the waist band center, and providing a 30-75 degree rotation of the cello, gave a good, natural wearing cello feel.

Optional Chest Extension

Figure 6:
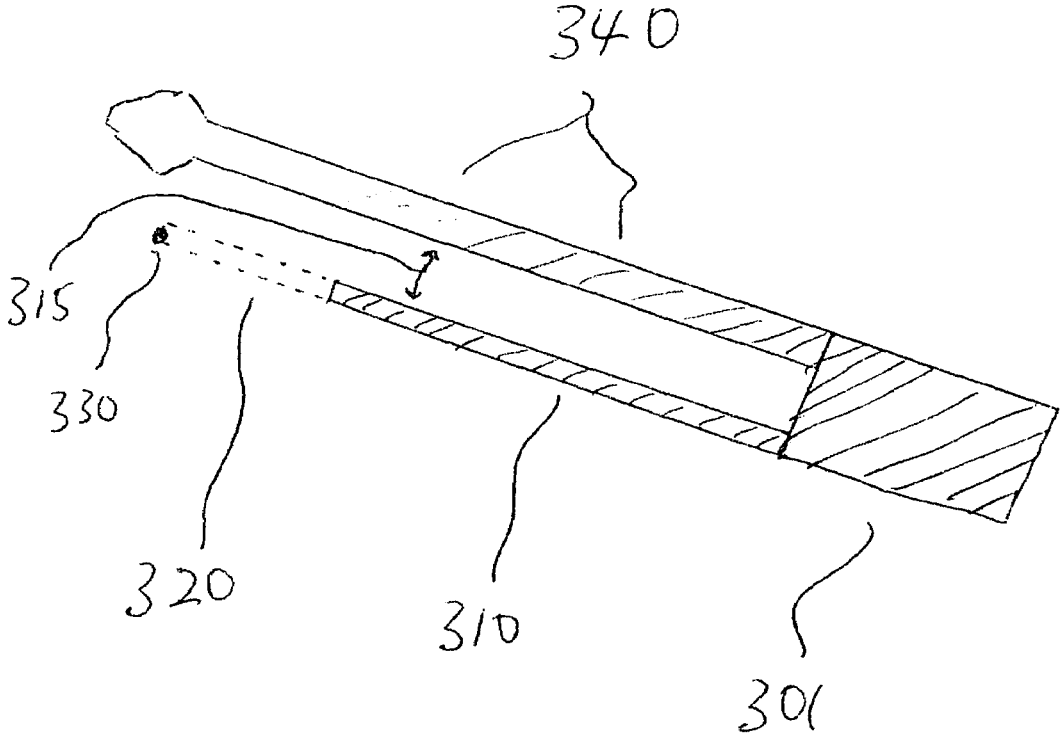
FIG. 6 shows a representative chest extension brace according to an embodiment.

As exemplified in FIG. 6, base 301 (or for example, lower cavity 7 as shown in FIG. 1) of the cello preferably has a chest extension brace 310 (3 in FIG. 1) that leaves a space 315 behind the keyboard 340 to allow a playing hand to extend along most of or all of keyboard 340 within space 315, without encumbrance. Preferably at least 9 inches, 10, inches, 12 inches, 14 inches or more of space is available between 310 and 340. Preferred cellos were made with fixed length chest extensions of 13 inches. Chest extension 310 desirably may be adjustable to extend out as exemplified by dotted extension 320 and most desirably has a strap connection at its proximal end (position 330).

Preferably the chest extension is within 30 degrees of being parallel to the fingerboard. In an embodiment the chest extension is within 10 percent of being parallel with the fingerboard. That is, the top point of the strap mount (if used) and the bottom attachment point to the cello body forms a line that is not parallel to the fingerboard, but somewhat away from being parallel to accommodate the need to position the cello top on one side of the neck. Desirably, the chest extension is positioned to be more vertical than the fingerboard during use. In a preferred embodiment the chest extension top is closer to the finger board than is the chest extension bottom, to thereby allow the fingerboard to slant more towards the user's neck.

Chest extension 310 in an embodiment is shorter than fingerboard 340 and preferably is between 1-20 inches, 2-10 inches, or even 3-8 inches shorter than the fingerboard when fully extended. An adjustable chest extension adjustable was found advantageous because the height of a strap mounted to the extension affected playing comfort. By sliding, remounting (with a fastener such as a screw, wingnut, magnetic latch, clamp or the like) or otherwise adjusting chest extension 310 to extend different lengths (exemplified as dotted line 320) shoulder pressure was alleviated. A taller player, for example, will want to extend the chest extension longer than a shorter player, so that any optional strap attached at 330 will exert less undesirable force on the body during prolonged use. In an embodiment, chest extension 310 is adjusted so that mount point 330 is between 0 and 3 inches from the top of the shoulder.

In an embodiment the chest extension may exist as two or more parts as will be appreciated by a skilled artisan, who may for example build this with parallel rails or with two or more telescoping pieces. In an embodiment one or more electronic controls are provided in or on the chest extension. Any control, rotary, sliding, touch sensitive, toggle, or otherwise, used for any purpose such as audio volume, stereo/mono switching, degree of reverb, depth of reverb, reverb time, equalization, bass boost, tremulo, on/off switching, radio output switching/.frequency, reference tone output for tuning, and the like may be used in this regard. Desirably the chest extension comprises an elongated section of wood and the wood contains a sliding control for volume or for controlling reverb or other parameter, wherein the sliding control can be physically moved at least 1 inch, 1.5 inches, 2 inches, 2.5 inches, 3 inches or more by the user's thumb while playing.

Signal Generation and Manipulation

While discussed in the context of a cello, this disclosure and particularly the following description applies to other stringed instruments such as violin, viola, bass, banjo, and guitar.

Transducers

An electric cello in many embodiments uses one or more sensors to convert vibrations that originate with the strings into electronic signals that optionally may be processed and amplified to produce music.

An embodiment provides new and improved transducers. Piezo electric transducer systems were explored that provide improved sound and sound systems.

1). Piezo electic sensors are preferred in many embodiments. Most preferred are organic material based (often polymeric) sensors, such as those sold by Measurement Specialties Inc., a Pennsylvania company. Certain piezoelectric materials are particularly well suited that comprise polymers which can be cast in the form of plastic sheets or other forms and make particularly good, linear response sensors. Particularly, polymers known as PVDF (poly vinylidene fluoride) polymers are contemplated. The term "PVDF polymer" means either the PVDF polymer by itself and/or various copolymers comprising PVDF and other polymers, e.g., a copolymer referred to as P(VDF-TrFE) and comprising PVDF and PTrFE (poly trifluoroethylene). In an embodiment, a polymeric sensor is chemically bonded to a soft material such as a rubber, neoprene, or other foam.

Figure 2:
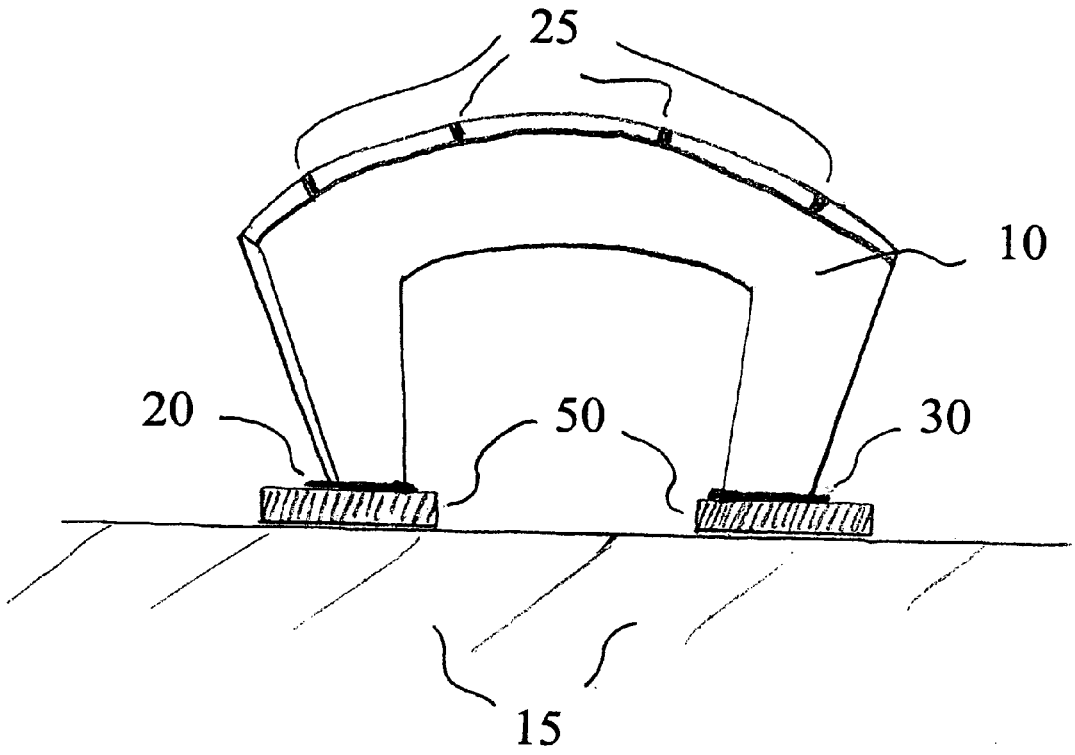
FIG. 2 shows placement of piezo electric plastic pickups and soft material according to an embodiment.

In a desirable embodiment one or more flat piezo electric sensors are positioned under one or more parts of the bridge such as under the feet of the bridge as shown in FIG. 2. FIG. 2 depicts plastic piezo film 20 and 30 under the feet of bridge 10. Sensors 20 and 30 may be positioned with same or opposite polarities facing up, and their outputs may be summed, or a difference may be taken, as suits musical taste. In an embodiment, it was found useful to connect both sensors separately via switches and to use one or the other as desired while playing, via switching. In an embodiment, the two outputs are input into two separate inputs of a differential amplifier and common mode signals are rejected. That is, spurious background noise such as 60 cycle hum that might be picked up by both sensors and/or their leads may be minimized via this balancing technique. In another embodiment one or more solid body piezoelectric pickups such as a ceramic is located in contact with or inside of a part of the cello, such as the bridge (if used).

In an embodiment two piezo sensors are used on opposite sides of the bridge in phase, and common mode signals are rejected for improved noise performance. In another embodiment acoustic modulation is used to produce sound multiplexing with two or more sound transducers and at least one amplifier. One transducer may be used to generate an acoustic signal that is amplified and turned into a vibration by the other transducer. The amplified piezo desirably is time delayed signal and preferably is controlled for undesirably (squealing) uncontrolled feedback.

In a most desirable embodiment sensors 20 and 30 feed two channels of an audio amplifier to generate a stereo sound. The stereo sound may be further developed by adding phase shift, or slight delay (5-35 ms) to one side and by changing equalization and/or phase shift between both sides, using software, hardware, or a chip such as the Philips TDA3810 or Toshiba TA1343N.

2. induction coil pickup(s) are preferred in some embodiments. An embodiment provides an induction coil (i.e. "humbucker") that is similar to that used in the electric guitar, having a wire wound around a metal wherein the metal is a magnet or is near a magnet and directs a magnetic field through the metal. An embodiment provides rare earth magnets for greater sensitivity and in some cases, greater immunity to noise. Another embodiment provides a wire wound around a magnet or paramagnetic or ferrous material. Desirably the coil is connected to a low impedance (i.e. less than 100,000 ohms, preferably less than 10,000 ohms, more preferably less than 3,000 ohms and even more preferably less than 1000 ohms. Preferably two or more induction coil pickups are used. In an embodiment, each coil is located equidistantly from two strings (such as the A and D strings; or G and C strings) and in another embodiment one coil is located under each string. In an embodiment, each coil is positioned in a different plane with respect to the others, but the center axis of the coil is perpendicular to the long axes of one or more strings. In another embodiment, pairs of coils are positioned for each string or string pair, and out of plane with respect to other coil pairs.

The outputs of pairs of coils may be compared via a circuit for common mode rejection, to reject at least some common mode noise such as 60 hertz hum that may be picked up by the coils. In many case two separate coils may be used per string. In an embodiment however, one coil is used for humbucking compensation for more than two other coils. The output of one coil may be used by a circuit to adjust the signal for two other coils, for example by use of a 60 hertz filter to pick out the presence of environmental hum. A skilled artisan with an understanding of humbucker technology used in electric guitars readily will appreciate how to connect two or more coils and process their signals to minimize hum. In an embodiment, the output signal from each coil is separately amplified, with separate gain adjusts, to allow loudness adjustment among the strings, or string pairs. For example, a coil sensor next to the C string may be more sensitive to the vibration of the larger mass of the C string, as compared with the smaller mass of the A string. Separate control amplification of signal intensity allows compensation for this effect.

3. light sensors Another embodiment provides one or more light sensors to detect string movement. A light emitter, such as a light emitting diode, preferably is matched with a light detector. Desirably the emitter and detector are combined in the same package and facing toward a string such that light reflected from the string is detected by the detector. In an embodiment, infrared light is used and in another embodiment, the light is modulated so that after detection, demodulation is used to extract the signal, with greater immunity from background light signals. Preferably the modulation rate is at least 20,000 hertz, 50,000 hertz, 100,000 hertz or greater. Desirably at least the emitter and/or detector or the two as a unit are located at the distal end of the fingerboard away from the user's head.

Vibration from the string(s) in an embodiment is carried into the bridge and the bridge vibrations may be sensed by one or more piezo electric sensors or other microphone(s). In an embodiment the bridge has a smaller size and smaller mass than a traditional bridge, to enhance the vibration of the bridge, as described above, in conjunction with sensors. Desirably the bridge (if used) may contact a surface by two legs, analogous to the traditional manner. This latter optional feature in some instances allows more flexing of the bridge and also more alternative ways to employ sound sensing, by for example, locating one piezo electric sensor in or under one leg and a second one in or under the second leg.

In another embodiment a vibrating bridge is not used, but one or more sensors are located near or at the contact points of the strings to their immobilizing points.

In another embodiment the strings are actuated electromechanically to create enough vibration for electronic detection. For example, a ceramic piezo driver or electromagnetic actuator may be attached to a string at or near the bridge, and moves the string to allow a natural vibration determined by the string length. Another detector such as a piezo pickup may be attached to the bridge or another location and can pick up the resulting vibrations. The fingerboard may be used in a regular manner to shorten the free string length and achieve higher notes. If one hand (left hand for example) is used for the fingerboard, the other hand may be used to control loudness by another input device such as finger pressure sensitive devices, one for each string.

Enhance Resonance

Some electric cellos sound dead before digital processing of the sensed signals. In some cases this is because an old fashioned style of wood bridge is tensioned on top of a solid body, which quickly dampens the cello string vibration sound. In other cases, the strings are held by a plastic or metal positioner, which absorbs string energy more readily than a traditional cello. Furthermore, some electric cellos dispense with a bridge altogether, and lack the inter-string energy transfer that gives the cello some of its melodious tone. Embodiments of the invention enhance resonance passively. Some embodiments enhance resonance actively, as reviewed next.

Passive Devices to Prolong String Vibration Decay Times

An embodiment alleviates the problem of string vibration quenching by providing a smaller bridge that absorbs less string energy in order to vibrate. In an embodiment, the bridge is positioned by string tension on top of one, preferably two, or more soft pads to facilitate bridge movement and allow longer string vibration decay times. Another embodiment provides a low friction surface under the bridge to facilitate longer vibration decay times. Another embodiment provides a lighter weight yet stiffer bridge material such as fiberglass to improve resonance. Yet another embodiment provides less string tension to prolong vibration decay time. Desirably 2 or more of these embodiments are combined for enhanced sound quality.

A bridge, if used, desirably should be less than 15 gm, 12 gm, 10 gm, 7 gm, 5 gm, 4 gm, 3 gm, 2.5 gm, 2 gm, 1.5 gm or even less than 1 gm in mass. Without wishing to be bound by any one theory of this embodiment of the invention, it is believed that the smaller weight requires less energy to obtain vibration in the weight. Desirably the bridge is at least 30%, 50%, 75%, 80% or more lighter in weight than a traditional cello bridge, or the bridge used by the Yamaha Silent Cello™. Preferably the bridge has two feet in the traditional sense, with one foot at one end and one at the other, with an axis between them that roughly is perpendicular to the strings.

The bridge desirably is tensioned on top of at least one soft pad. Preferably one or more individual soft pads are located under each foot of the bridge as shown in FIG. 2 as pads 50. The pad preferably has a thickness of at least 1 mm 2 mm, 4 mm, 5 mm, 6 mm, 8 mm, 10 mm or more and has a durometer, or average durometer rating of less than 100, and preferably less than 80, 60, 50, 40, 30, 25, 20, 15 or even less than 10. In an embodiment, a pad with a continuously changing durometer (softness) is used. In another embodiment multiple soft pads are used having different durometers. In an embodiment pad of about ¼ inch thick of about 20-40 durometer and positioned under the two feet of a bridge worked well. Thicker pads of at least ⅛ inch and preferably ¼ inch or more provided better sound.

The bridge preferably is stiff. In an embodiment, a hardwood such as maple is used. In another embodiment fiberglass is used. Fiberglass may employ a variety of glasses and polymer. Although epoxy is easier to use, polyester is more preferred due to its greater stiffness. Carbon fiber is preferred over glass fiber due to its greater stiffness.

Desirably, the string tension (pressure exerted by the string down upon the bridge) is less than that used in a traditional cello. The tension preferably is at least 10%, 25%, 35%, 50%, 66%, 75% or even at least 85% less than that used in a traditional cello. The amount of tension used in a traditional cello may be measured with a pressure meter between the bridge and the supporting surface, and taking an average of 10 cellos used in a local symphony orchestra.

One problem with playing the cello at night outside is the inability to see the bridge and bowing position carefully. An embodiment alleviates this problem by providing one or more light sources near (preferably within 3 inches, more preferably within 1 inch) the bridge and that light up at least either the bridge or the bow contact area near the bridge. In an embodiment, such light shines onto the desired bowing region near the bridge, and not on the bridge itself. In an embodiment, the player receives feedback for correct bowing position by seeing light reflect from the bow hair, energize chemiluminescent and/or fluorescent material on the bow or bow hair, activation of a notice light, or auditory signal such as modulation of amplitude of played sound. In a desirable embodiment, the bow hair contains fluorescent and/or chemiluminescent material and lights up in response to ultraviolet light (preferably from light emitting diodes) located on the cello. Bow hair may be impregnated with a fluor such as fluoroscein, or chemilumiphore such as europium based dyes by dissolving the dye in solvent (preferably non-aqueous), impregnating the bow hair with solvent-dye, and then evaporating the dye. This may be done for new bows before adding rosin. By shining ultraviolet light only on the position where the bow should be held and using fluorescent material in the bow, the user obtains instant visual feedback on correct bowing position, while not seeing appreciable light directly from the ultraviolet light source. In another embodiment the cello contains a light emitter/sensor combination positioned below the strings, to detect the bow by reflection off of the bow hairs. Infrared emitter/sensor combinations are preferred for the latter case.

Active Devices to prolong string vibration delay time

Electromechanical devices may be used to prolong resonance via feedback of energy into the strings. In an embodiment, the strings are held by their ends away from the user's head via electromechanical actuators that can add vibration energy. In another embodiment, a bridge is used, having an electromechanical actuator. In the latter embodiment, the actuator may be a coil surrounding a magnet. The coil, or more preferably the magnet, may be fixed to the bridge, so that electrical pulses into the coil feed vibration energy into the string(s). The actuator may be a piezo electric device and may be a magnetorestrictive material device or other device that converts electrical energy into mechanical energy.

In an embodiment, a sensor detects string vibration and this signal is amplified and (after optional processing) is fed back into the bridge via the electromechanical device. Preferably, the bridge has two feet that hold the bridge up in the typical fashion, such that the sensor is located at one foot and the electromechanical device is located at the other foot. A phase shifting signal processing or hardware circuit may be used to make the physical vibration output sum with the vibration energy. In another embodiment, the actuator feeds vibration energy out of phase, into the bridge, to dampen an undesirable sound. In another embodiment, a middle foot is provided, with a piezoelectric pickup under the center foot.

Signal Processing

Interharmonic

Part of the richness found in the cello sound arises from interharmonic modulation, wherein, for example, two vibrations combine to produce additional vibrations of different frequencies corresponding to their sum, differences and products. Embodiments of the invention provide two types of modulation to lend an electric stringed instrument this characteristic. One, the modulation can occur via mechanical vibrations interacting and two, the modulation can occur electronically.

Mechanical modulation according to an embodiment occurs when an output device such as a loudspeaker or piezo crystal driven by a circuit feeds back acoustic energy to a pickup device such as a piezo electric crystal, wound coil or microphone.

Electronic modulation according to an embodiment occurs in hardware. An example of hardware based modulation is the introduction of two or more signals into one or more diodes or other non-linear devices. Electronics artisans, particularly in the RF radio transmission and reception field are long familiar with such devices. In the audio realm, a ring modulator, either balanced, or unbalanced, often has been used. A balanced ring modulator for example, generates sidebands (addition, subtraction and multiplication modulated signals from two source signals). Such modulation can generate a composite signal that lacks the original input (i.e. less than 10%, 2%, 1%, 0,3%, 0,1% or even less of the original) signals in the total power output. Such modulation output can be added back to a signal to add richness to that signal. In a particularly desirable embodiment, a source audio signal is processed into a delay and the delayed signal is combined, or "mixed" with the original in a modulator, to produce sidebands. In yet another embodiment, a pure sine wave, or series of harmonics such as from a square wave, sawtooth wave, or other shaped wave, is input into the mixer, and an audio sensed signal from the cello is also added, to produce sidebands.

In an embodiment, the ability to inject for example, a sine wave or series of sine waves corresponding to a note allows a melodic theme by choosing the key of a song to be played, and providing a corresponding note of that key (eg. a C note for a song played in the key of C) to input into the modulator for forming side bands. In another embodiment, one or more notes such as the A, D, G and C note(s) that correspond to individual string(s) may be presented to a modulator and mixed with a detected signal to provide modulated feedback for string tuning and to liven up a performance. For example a sine wave or set of harmonics corresponding to a C note is entered into a ring modulator and a cello acoustic signal is entered into the same ring modulator. When a song is played in the key of C, notes are compared with C and an output (sum, difference, product) from the ring modulator are output. This ring modulator output may be blended with the cello acoustic signal to create a rich composite. The ring output in an embodiment is less than 20%, 10%, 5%, 20% or even less than 1% of the rms composite signal strength.

Stereo Cello

An embodiment provides stereo cello by sending at least some of a signal from the left sensor of a cello bridge to a first channel and at least some signal from the right sensor of a cello bridge to a second channel. Experimentally it was found that, especially for hardwood bridges that attenuate vibration from one side of the bridge to the other, such stereo separation or partial separation provides an enjoyable separation in space of notes played from one side of the cello to the other. Most desirably a thin piezoelectric pickup is positioned under each bridge foot. In an embodiment at least two amplifiers are used to process signals from at least two sensors to provide such dimension, which can be enjoyed by stereo headphones, or by a stereo amplifier and speakers. Further analog and or digital enhancement may be obtained with a stereo enhancer chip or software as is known to skilled artisans. In another embodiment, one sensor under one bridge foot (or a sensor located elsewhere) is used to generate a signal output, and a piezoelectric transducer is located under a bridge foot (or the other foot) to produce feedback. Desirably, the input signal to the feedback transducer is driven by an echo (delay circuit) and can in some instances more faithfully emulate the sound of a natural old fashioned cello.

Two or more output channels can be used to present differing echo signals. For example, audio signal from a sensor can output to a first channel and the same audio signal after reverberation (echo) processing can be output (or simply mixed into) a second channel. In an embodiment, two different echo signals are used. A first echo signal with a first delay time is made from one type of signal, such as from a first sensor at the bass side of the cello, or from lower frequency filtered signal. A second echo signal with a second delay time is made from a second type of signal, such as from a second sensor at the treble (A-string side) of the cello, or from a higher frequency filtered signal. These two echo signals may be further mixed and/or output into two channels. In a desirable embodiment, a first reverb circuit with less high frequency attenuation is used for a shorter echo time (e.g 10-100 msec) for a treble or higher frequency signal, and a second reverb circuit with more high frequency attenuation is used for a longer time (e.g. 75-250 msec) for a bass or lower frequency signal. For example, signal from a pickup on the treble (A string side) foot of a bridge may be processed for shorter echo and less high frequency filtering while a signal from the bass (C string side) foot of the bridge may be processed for longer echo and more high frequency filtering. By providing two or more types (delay characteristics) of echo, particularly matched to pitch, a more natural echo can be recreated.

In an embodiment, the tonal quality of the stereo cello is enhanced by increasing the low bass (response maximum between 30 and 200 hertz) for the C string side pickup more than for the A string side pickup. In another embodiment enhanced special response is obtained by use of the TDA3810 chip, use of comb filters as is known to skilled artisans, or other circuit or software that provides creation and/or enhancement of stereo signals. An embodiment allows user selectable stereo enhancer mode, similar to that generated by circuits that employ the TDA3810 chip. In particular, a user optionally may select to have the left, right, or combination (blended left and right) piezo electric signals to undergo stereo enhancement from a mono signal, as is known to skilled artisans. Also, regular left and right signals can be selected for regular stereo, or selected for stereo enhancement. In another embodiment one or more of these modes can be used in combination with digital reverb processing. In yet another embodiment, left and right signals are blended, with optional phase change, to form a more complex mono signal.

Reverb Generation, Control

Desirably electronic reverb is added at the cello or outside the cello. A high speed sampler that stores audio signal information into an array and then reads out the information may, for example be used. The reverb time preferably is between 0 and 2 seconds and more preferably between 0.02 and 0.5 seconds. The time of delay and proportion of delayed signal with undelayed signal may be adjusted. In a particularly desirable embodiment reverb is added to two channels of a stereo cello (or other stringed instrument such as a violin). The instrument player may adjust the reverb during play by manipulating a control on the cello or by a foot pedal.

In a particularly desirable embodiment the amount of delay, (delay time, or amount of delayed signal or both, but preferably delay time) is adjusted by a foot pedal. Desirably the foot pedal is attached to a control, such as a linear taper potentiometer, allowing the user to continuously adjust the degree of reverb. This allows the user to play music at little or no reverb, but then slowly add reverb, or even suddenly add a longer amount of reverb to the very end of a piece of music, to give a special effect of a final, long echo. Accordingly, one embodiment contemplated is a stringed musical instrument system comprising a stringed instrument and attached/attachable continuously adjustable reverb foot pedal. Desirably, the foot switch allows a movement of at least ½ inch, at least ¾ inch, at least 1, 1.5 or even at least 2 inches of vertical movement associated with delay time and/or amount of delay signal. In an embodiment the foot switch itself contains a single or dual gang (for stereo) potentiometer and the reverb circuitry may be placed with the footswitch box.

Electronic Modulation via Computer Processing.

Training wheels for the player.

A desirable embodiment provides enhanced output for correct or desirable notes, while dampening, ignoring or enhancing less, undesirable notes. This selective enhancement can provide guidance feedback to the player and particularly the inexperienced player, who may have trouble hitting the correct notes. Most desirably, an enhanced output provides selectivity for one or more notes of a scale and a note played off that scale which is not an enhanced note will result in less audio output volume compared to a selected note. In an embodiment, 4, 5, 6, 7, 8 or more notes of a scale are enhanced this way. Enhancement may be carried out mechanically via one or more tuned resonance systems coupled to the system, or more preferably, electronically, via digital or analog circuit processing that enhances selected notes.

In a mechanical embodiment, extra string(s) are used as tuned resonance systems. For example, 2, 3, 4 or more passive strings may be tensioned to resonate to one or more notes on the selected scale. These may be physically attached to a bridge so that bridge vibration is transmitted to these extra string(s). By way of example, a standard cello with A, D, G and C strings attached to a cello may contain other passive string(s) tuned to B, E, and/or F (or less desirably, additional string(s) tuned to A, D, G and/or C). When a player of such system hits a B note and a passive B note resonating string is used, the B note resonates longer and provides more audio presence. In contrast, a B flat note would not excite the passive string system. In this way, the passive strings provide improved sound and discriminate against undesired notes.

In an electronic embodiment, selective enhancement of notes (optionally including, for example, their fundamental frequencies plus harmonics) is carried out by computer or by hardware. A skilled artisan can design or build circuitry that preferentially responds to desirable notes of a scale. The electronic audio signal from the stringed instrument (such as electric cello, violin or bass) may be processed, for example, by multiple active filters, each tuned to a note. The outputs of the active filters may be mixed to produce a composite signal.

Computer processing is particularly desirable for obtaining selective enhancement. Typically, a scale is selected and software is instructed to emphasize correct notes. The emphasis of correct notes, in both hardware and software systems, may be set to or adjusted to different qualities. Most preferably, the selectivity (or width of acceptable note frequency) may be narrow or wider, and the degree of selective enhancement may differ. For example, each note may have a narrow acceptable frequency range of plus and minus less than 1, 2, 3, 5, 7, 8, 10, 12, 15 or up to 20 hertz, with respect to the frequency of the lowest, or fundamental frequency of a note. An arbitrary measurement in this regard is the location of a 3 db cut off on either side of a center frequency of the note. For example an A note of fundamental frequency 440 may have a plus or minus 2 hertz "selective enhancement region" wherein signals within 438 to 442 hertz are emphasized by an average (weighted evenly within this interval) of at least 3 db with respect to signals immediately outside this narrow band pass. Most desirably, the overtones (2nd, 3rd, 4th, 5th etc. harmonics) associated with the note (876 hertz to 884 hertz) also are emphasized with respect to their adjacent frequencies. In practice, "emphasis" may be measured by taking an average of the emphasized range (438 through 442 in this example) and comparing to other ranges immediately outside the selected range.

An embodiment provides a string instrument such as a cello, violin or fretless guitar wherein desired notes of a scale are selectively enhanced. Most desirably, the notes are associated with a particular scale that the user may select, and the degree of enhancement also is selectable. In this way, a new student may more quickly become familiar with the scale and the correct placement of fingers to obtain a correct note of that scale.

In a particularly desirable embodiment, one or more computer chips such as a microprocessor are used to emphasize correct note (desirable notes such as the notes of a desired scale, and not off-notes) frequencies over incorrect note frequencies. Such digital processing may be used in a wide variety of stringed instruments, particularly those that lack frets, such as fretless bass guitars, cellos, violas and violins. Circuits, software and instruments that have these features are contemplated and can for example allow a player to play correct notes more easily without frets.

Most desirably the degree of discrimination of correct note frequencies is selected by a switch or control knob. In one such embodiment, an electrical signal from a plucked or bowed string is input into an analog to digital converter at a rate of at least 5,000 hertz, 10,000 hertz, 15,000 hertz, 19,000 hertz, 25,000 hertz, or at least 40,000 hertz. Digitized output then is processed by one or more microprocessor-computers. In one embodiment, fourier transform is used to generate a value or set of values corresponding to a given note and then compared with stored values. In one type of comparison, if the comparison indicates that the note is very close to or identical with a desired note (such as the given notes for a particular scale or scales) then the note is not attenuated, or may be enhanced. On the other hand, if the result of the comparison indicates that the note is off key, then the note is attenuated, not amplified as much as an on key note, or maybe ignored (is not processed further into a sound), After such manipulation(s) the digital signal(s) corresponding to the note are converted back into a larger signal that can be converted into sound, by an amplifier and loudspeaker, for example.

In another embodiment, after comparison of the digitized signal with a reference (acceptable reference notes from a scale for example) a note that is found to be slightly off key is adjusted up or down into correct key. Use of fourier transformed representations of sound are particularly useful for this embodiment, because the mathematical representation of the note can be adjusted mathematically into key.

In an embodiment a signal such as a light, sound, mechanical vibration shaking, or even an electrical shock is presented to the player to alert the player of the presence and/or degree of the mistake in the played note. In an embodiment, a user can select a desirable scale by a switch or other signaling device. The degree of correction also may be adjusted, as will be appreciated by a skilled artisan. The embodiments of electronic note comparisons and adjustments as reviewed here are particularly useful for fretless bass guitars, where often one note at a time is played. In another embodiment, the notes are adjusted to become off key by computer manipulation. In yet another embodiment, the notes of one key are transposed to notes of another key, as selected by the player.

Output of Music

Modern electronics may be used to enhance the musical experience. In one embodiment a headphone jack is provided at the top (proximal) end of the cello, to provide easy access to headphones where most needed (by the user's head). Desirably, the headphone jack is located facing the user (on the right side or edge of the cello top part) so that accidental pulling away of the cello from the user's head would allow removal of the jack in the direction of movement instead of possible bending or stress on the wires, that would occur if the jack were behind the instrument. In another embodiment a microphone is provided at the top of the cello on a holder that can be positioned or bent towards the user's mouth. In this case, the microphone output optionally may be transmitted from the cello to a receiver, and then amplified.

Cello Karaoke

In a desirable embodiment, the electric stringed instrument is played with music accompaniment from an electronic device attached to or within the instrument. In 2005, the iPOD and similar solid state memory based personal music devices are ideal for providing this. Desirably, the instrument has a mount for the personal music device. For a cello instrument, the mount preferably is on the lower half, and preferably at the optional chest brace. An attachment suitable for affixing the personal music device may include a magnet, clip, Velcro, sheath, snap, button, pouch, box or other fastener/container to allow easy storage of and use of the playback device. Most desirably the instrument has a stereo input plug such as an approximately ⅛ inch standard plug such that the playback device output is mixed with the cello output and can be listened to over headphones. In another embodiment the playback device is plugged in and is heard over the cello speakers. In yet another embodiment the playback device has a radio frequency or infrared signal output and the cello has a receiver, to allow the playback device signal to transmit wirelessly to the cello.

In an embodiment, one or more tracks of cello music output (with or without optional playback device for karaoke) are broadcast as radio frequency signals out of the cello to a receiver. Desirably, the frequency used is highly controlled such as by use of a crystal frequency reference to allow continuous monitoring of the sound. The output may be a standard mono or stereo FM broadcast signal (FM modulation on the 88-108 broadcast band) and capable of being received by a broadcast receiver. A bluetooth transmission is particularly desirable in another embodiment. A kit may be provided, that includes wireless headphones and a cello that broadcasts suitable signals to the wireless headphones.

Cello Training Systems

In a desirable embodiment a cello (or other instrument: cello is used as an example) training system is provided wherein a music book or file (electronic file and/or paper) is provided along with music and/or optional video or audio instruction. The instruction preferably is from the internet and is downleaded directly or indirectly into the cello or accessory to the cello (such as a memory stick that transfers to the cello). An embodiment further provides an LCD visual output attached to the cello, allowing instructions to be displayed while wearing the cello. Music score display for marching band use also may be displayed this way and input from the internet or other source. A system may for example comprise an audiovisual interface that is built into the cello or attachable to it (as an accessory) and a device or system for inputting software.

The device or method may be a memory stick, which accepts information from a computer, a compact disc, or other storage device. A system may also provide an access code for obtaining information from a web site. In an embodiment, a student obtains a lesson from the internet, the inputted lesson is displayed on the cello (or is activated by a switch), and the cello senses the quality of the student playing, such as monitoring correct bow movement, correct tone creation and rhythm. This information is stored and may be reviewed by the student or even sent to a remote teacher for individual or mutual review. Of course, individual or subcombinations of components as described here may be employed.

Correct bowing is very important to stringed instruments and an electronic feedback system is provided to assist learning the proper technique. In one embodiment the perpendicular placement of a bow to the fingerboard axis is monitored and a correction signal output to the user. This system, in its more basic conformation includes a first sensory monitor of perpendicularity and a second output device. A sensory monitor may for example continuously monitor the fingerboard axis with one, or (preferably two or more) tilt sensors, one or more magnetic sensors or other sensors as a skilled engineer readily will appreciate. The bow position itself is monitored, either by sensors on the bow, which output a suitable signal(s) for comparison, or by monitoring indirectly.

In the latter instance, the bow desirably includes one or more magnets or ferromagnetic material, to be detected magnetically by sensors on the stringed instrument, or may be detected optically by optical probing of markers on the bow. Preferably the bow contains resonance or inductive resonance bodies, such as those used for card key systems, and the stringed instrument emits probing signals that return reflective or induced signals from the bow commensurate with proximity. In an embodiment two or more sensor types (using two or more frequencies or frequency sets) are used to probe and obtain information from at least two dimensions or points of bow position. This system may be used to determine: 1) how perpendicular the bow is to the strings (compare with fingerboard or string axis); 2) how close the bow is to the fingerboard; 3) timing; and/or 4) how flat the bow hair surface is on the strings. A skilled engineer can derive suitable sensors, receivers, and comparison software for determining correction signals.

Correction signals may be output to the user a variety of ways. Optical feedback may occur by flashing or colored lights, or an LCD panel for example. Tactile feedback may occur by differential weighting of the bow (via magnets, or other means) electromechanical adjustment of a weight in the cello, or a vibrator for example. Audio feedback may occur via a buzzer, speaker, or voice comment from a speaker for example. In another embodiment the degree and or frequency of correct or incorrect placement of the bow is monitored and this information is stored for later review by a teacher. Such information may be input and sent through the internet to a long distance teacher for review, and may be graphed or charted to show the student's progress.

Similarly, the stringed instrument may monitor the tonal accuracy and/or rhythm of music or other sounds played. In an embodiment, a reference set of sounds, such as a melody or practice bowings is selected, and the student plays the selected piece. The stringed instrument monitors the frequencies of the played music and compares with the selected (stored) optimum frequencies, and outputs (stores) a set of values corresponding to the deviations from the stored values. These deviations are output to the player and or to a teacher in a similar manner as described above for bow correction. In a very basic implementation of this embodiment, the student plays a single note and the instrument listens and directly feeds back a correction signal.

On board and/or attachable speakers

In an embodiment the electronic output may be converted to sound vibrations in or on the cello itself, via one or more small speaker(s) in the lower unit, or else, worn elsewhere on the player's body. In an embodiment, at least one or two sensor outputs are optionally processed and then amplified by one or two audio amplifiers of at least 2, 5, 10, 20, 25, or even more watts per channel RMS output. The output preferably is sent to small speaker(s) in the cello itself, preferably 3-4 inches diameter or larger. In an embodiment, a rectangular or small 3-5 inch diameter speaker is positioned on the right side of the cello and a small speaker is positioned on the left side of the cello, both facing out and within an air tight chamber. In an embodiment, improved bass response is obtained by driving two or more speakers that share the same acoustic chamber with a common signal (either exact same signal or same bass component in different signals). By moving the speaker cone if the same direction simultaneously, a lower bass response is obtained.

In another embodiment, a speaker is reversibly attached at the bottom end of the cello, and preferably by attachment to the user side of the chest brace (if present). In an embodiment, a vibration isolation material, such as a layer of rubber, neoprene, or other plastic is interposed between the speaker and the instrument. In an embodiment the speaker is attached reversibly by magnet(s) located in the speaker and/or in the instrument. Another embodiment provides a cello case having its own electric power supply, speakers and amplifier. This allows the user to plug in (or use radio transmission or IR light transmission) signal from the wearable cello to the cello case, which provides sound.

Experiments were carried out with small amplifiers (1 to 10 watts RMS) and a variety of speakers. Results indicated that small speakers could work well in the cello body itself, placing a speaker in an optional shoe worked better, but using a large speaker in a large cavity not attached to the cello directly, worked best. The best sound came from placing a larger (6 inch diameter or 6×9 oval) speaker in or adapted to large tubing. Most preferred for marching band use is an elongated/folded tube speaker cabinet that can be worn (for example on the back) and having one or two speakers at the end(s). A six inch inside diameter tube can be folded with total length of at least 1.5 feet, and preferably at least 2 feet, 2.5 feet, 3 feet or more for good sound. Batteries and amplifier may be placed inside the enclosure or preferably attached to the outside.

In an embodiment, an independent music source such as an iPOD or other electronic music playback device outputs into the cello to allow the cellist to play "cello karaoke" along with the recorded music. Preferably the cello has, such as on its lower half, and preferably at the optional chest brace, an attachment such as a magnet, clip, Velcro or other fastener to allow easy storage of and use of the playback device while wearing the cello.

Tuning References, Auto Tuning

An embodiment provides one or more built in reference tones for tuning. Desirably a 220 Hz, or 440 Hz sine wave or complex (such as square wave) signal with a fundamental tone at this frequency is used. Additional tones corresponding to each string also may be included. The sound may be manually switched and/or may be automatically switched. For example, a timer in the cello can sense if at least: 1) a significant temperature change has occurred that might be expected to alter string tension (more than 1, 2, 3, 4, 5, 7, 10, or more than 15 degrees Fahrenheit for example); 2) a long time (e.g. a day, two days, week or more) has elapsed since the cello has been turned on; and/or 3) string tension has changed since the last time the cello was on, or over a given time period.

Cello Raincoat, Water Resistant Bowing Systems

Figure 7A:
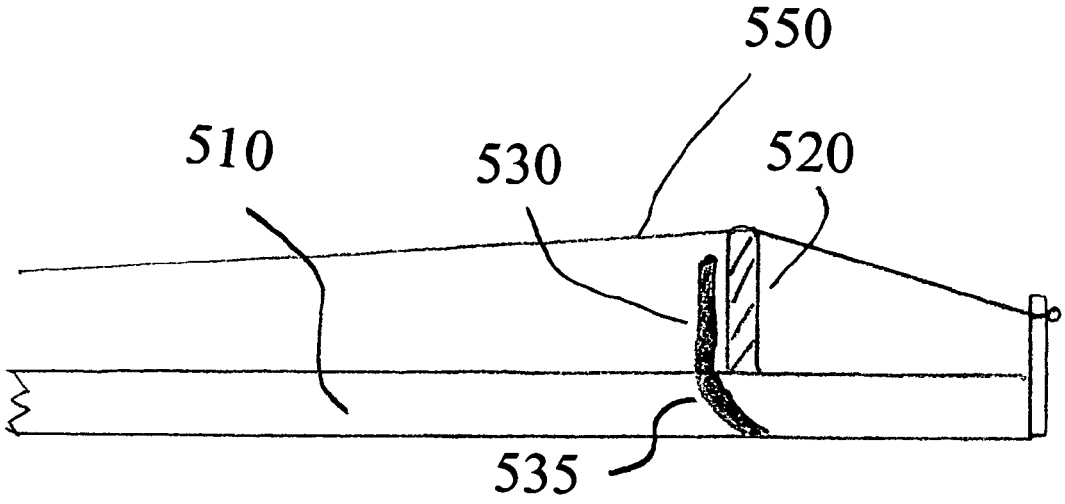
FIG. 7 shows a rain lip and bridge cover used to keep water from contacting a bridge according to an embodiment.

Embodiments provide enhanced use in outdoor environments. In one embodiment a bridge is used to hold the strings, wherein the bridge is a plastic, plastic composite, or treated (eg. urethane coating or plastic coated) wood that resists rain. In another embodiment (see FIG. 7A) cello body 510 above bridge 520 (towards the users head) has rain lip 530 just above bridge 520 such that rain falling on the fingerboard does not run down the body and into the bridge region, or on the bridge but is shunted away as shown in FIG. 7A. Rain lip 530 desirably is perpendicular to the strings and near and parallel to (e.g. within 0.5 inch, 0.25 inch, 0.1 inch) of bridge 520 and is almost as high (within 0.1 inch, 0.25 inch, 0.5 inches) as strings 550 held by the bridge. Lip portion 535 is a short ridge on the side of the instrument to allow water from the top (away from bridge) side of lip 530 to run off the side of the cello.

Figure 7B:
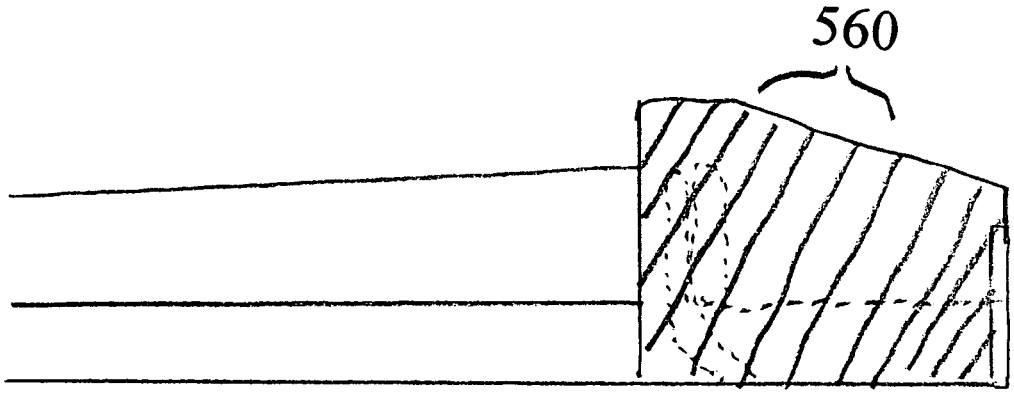

FIG. 7B shows the same side view with bridge rain shield 560 ("bridge raincoat"), which is removable and keeps rain from falling directly onto the bridge. In an embodiment no bridge is used and the entire fingerboard and bowed string region (bottom region) is waterproofed with a water resistant coating and/or made from water resistant material. In another embodiment the entire body of the cello exposed to the elements is made from and/or treated with water resistant material.

An embodiment provides a heated fingerboard. This is particularly useful for marching band use in the winter. The fingerboard may be heated via use of conductive graphite and impressing a low voltage (preferably less than 50 volts, more preferably less than 36 volts, 12 volts, 5 volts, and even more preferably less than 2 volts) through the graphite. For example, a DC voltage may be impressed from the bottom of a graphite surface or solid to the top. A battery that has preferably between 1 and 200 watt hours, more preferably between 5 and 25 watt hours of energy may be used to generate heat at a 0.5 to 50 watt and more preferably 1 to 10 watt rate over that surface or solid.

In another embodiment a bridge is used with a fixed or removable rain coat (i.e. shield) that prevents rain from falling on the bridge and/or nearby region, including a pick up sensor, if used. The rain coat should start immediately below the bowing area (e.g. within 1, 0.5, 0.25 or even 0.1 inches above the bridge) and may extend below the bridge by at least 0.1 inch, 0.25 inches 0.5 inches, or may extend all the way down to the cello body bottom. In a particularly desirable embodiment a wood bridge is used with one or two piezo sensors under the bridge feet, and a soft pad, with a removable shield that covers the bridge so that rain does not fall directly on the bridge feet and wet the pick up(s) or pads as shown in FIG. 8B.

The cello bridge raincoat may be mounted on the bridge itself (clipped to the sides for example), or mounted somewhere else on the cello body such as by snapping, clipping or sliding into a fastener on the cello. In an embodiment the cello bridge raincoat has a magnet in it that holds the raincoat onto the cello body, or that has a magnetically responsive metal in it to allow attaching to a magnet on the cello body. Desirably such a cello bridge raincoat is used along with a rain lip above the bridge to prevent rain water from falling directly into the bridge or running into the bridge from another region. In an embodiment the bridge raincoat does not cover the bowing region and allows the use of the bow in the rain. In another embodiment the raincoat covers at least partly the bowing region, but still allows plucking the strings.

Three other types of cello raincoats may be used, a headstock raincoat, which covers the top end of the cello just above the finger nut but allows use of the fingerboard in the rain, a fingerboard raincoat that additionally may be used to prevent rain from falling on the fingerboard while waiting in the rain, (sitting in the stands during a football game for example), and a larger raincoat that covers both the top of the cello and at least the fingerboard (optionally the entire cello to the bottom). The raincoat may be for example a flexible plastic or a stiff material.

The raincoat may be a separate component that is reversibly mounted to the cello, or may be a lightweight, thin fabric that is fixed to the back (and or top) of the cello and out of the way while playing, but unfurled to cover the cello when needed as a raincoat. Desirably the raincoat is folded into a small pouch in the area on the headstock above the fingerboard and behind the string tuners, when not needed. During use the fabric is taken out and covers some, most or all of the cello body (preferably excluding a waist mount). In another embodiment a long backpack is provided analogous to a quiver for keeping one or more bows. Optionally this quiver is large enough to store or transport the cello (minus the waistband or belt) when not played.

Water resistant bowing components and systems also are provided that allow cello (and/or other stringed instruments) use in the rain or snow. Without wishing to be bound by any one theory of this embodiment, it is believed that bowing a stringed instrument in the rain leads to sticky bow syndrome, via hydrophilic (and capillary) adhesion of water to bow hairs and rosin. This adhesion makes a mess out of bowing and otherwise may prevent cellists from joining their brethren woodwinds and brass players of the marching band during less than perfect weather. To counteract this tendency, a hydrophobic rosin is provided that gives friction to the bow but that repels water.

A variety of hydrophobic materials can stick to natural horsehair and/or synthetic bow hair and can be appreciated or selected by a skilled artisan upon routine optimization. The art of hair and leather treatment is replete with numerous examples of lotions, pastes, waxes, cakes, dispersions and the like that impart water repellency to hair or leather and are candidates as rosins on bow hair to improve bowing friction with strings. Desirably, a water repellent rosin is prepared by neutralizing the abietic acid rosin compositions via, for example, adding a cation such as aluminum and making a salt by reacting with base. The use of a more hydrophobic rosin made by base treating abietic acid containing material for marching cellos outside is particularly contemplated. Chemical reactions relevant to this are known, and some may be found in the corresponding sections of one or more of U.S. Pat. Nos. 5,037,956; 5,773,391; 5,886,128; 6,013,727 and 6,469,125 the relevant sections (particularly chemical agents and reactions) of which are specifically incorporated by reference in their entireties. The paper making industry often uses rosin systems that are made hydrophobic and such prior art chemistry particularly is contemplated. In an embodiment, a synthetic bow hair with more hydrophobicity (water repellency) than regular horse hair is combined with a hydrophobic rosin and used for bowing the outdoor stringed instrument. Desirably, composite bows are used that are made from synthetic materials to alleviate warping.

Collapsible Cello

Another embodiment provides a cello that can be readily disassembled to fit into a box such as for example a box with total dimensions (length plus width plus height) of less than 48, 44, 42, 40, 38, 36, 34, or even less than 32 inches. This embodiment allows packing of the cello into on-board stowable luggage for airplane travel. A preferred box is 24 inches (plus or minus two inches) long by 12 inches (plus or minus one inch) wide by 4 inches (plus or minus two inches) high.

Preferably the collapsible cello comprises three portions: a head stock portion, a fingerboard portion, and a tail portion. The head stock may include string tuners and preferably is terminated at the bottom end with a post that slides into a receiving sleeve mounted in the fingerboard portion. The tail stock portion includes the portion beyond the fingerboard and may include the bridge, if a bridge is used. The tail stock is terminated at the upper end with a post that slides into the lower (wider) end of the fingerboard portion. In a preferred embodiment the posts are not round but are rectangular (such as square) or other shape to prevent rotation of the 3 parts. Alternatively, round posts may be used and the mating ends of the 3 pieces interlock to prevent this rotation. A chest extension/brace preferably is part of the tail portion or is a fourth portion. A waist mount (if present) may be flexible to insert into the box and/or may comprise 2 or more sections that may be taken apart and reassembled.

Although the above description focuses on desired embodiments, the same materials and methods are intended for use in other systems as well. For example, although described in the context of a cello, many of the embodiments are intended for use with electric violin systems too. Other permutations of embodiments will be appreciated by a reading of the specification and are within the scope of the attached claims.

EXAMPLE 1

In this example music was played on a cello having a bridge weighing less than 3 grams, with individual neoprene foam pads between the bridge feet and a hardwood base, the neoprene having a thickness of between ⅛ and ¼ inch and a durometer of between 10 and 30. Good results were obtained. Replacement of the neoprene with harder neoprene of durometer rating of 40, 60 and 80 yielded sound that was progressively more dull. Replacement with rubber of the same approximate durometer yielded a more durable system. For the bridge material, maple gave the best results.

Oak yielded a slightly more dull sound. Soft woods were studied and gave some interesting sounds, with unexpected resonances away from the natural open string frequencies.

Bridges were made by cutting down standard German made maple cello bridges. More than 4/5 of the bridge wood was removed. A similar bridge made from bola wood was heavier and gave poor (dull) sound performance. Thin plastic piezo sensors were positioned under the neoprene (and rubber, when used) pads and above the hardwood base. When individual piezo sensors under the left and right bridge feet were compared, it was found that sound from bowing a given string was more brilliant from the sensor located under the bridge foot closest to the string. The use of both signals played back through computer monitors gave very pleasing results and exceeded the quality of several reverb circuit enhancements that were evaluated.

Other embodiments and combinations of embodiments will be appreciated by a skilled artisan upon reading the specification and are intended to be within the scope of the claims. All cited documents and particularly structural details of instruments, circuits and devices used for electric stringed instruments described in cited patents and patent applications are specifically incorporated by reference in their entireties.

I claim:

1. An electronic stringed instrument having multiple strings, a bridge that holds up the strings, and one or more sensors to sense bridge movement, wherein the bridge is perpendicular to the strings and has a height between 2.1 and 3.1 inches.

2. An electronic stringed instrument having multiple strings and a bridge with two feet, with soft material of softness durometer less than 50 interposed between at least one bridge foot and the base, and one or more piezoelectric sensors sandwiched between one or more bridge feet and the soft material.

3. An electric string instrument, comprising a fingerboard, a bridge with two feet and having a height to width ratio of between 0.4 to 2 positioned perpendicular to the strings, wherein each bridge foot is mounted on the instrument through one or more soft pads that are at least $1/8^{th}$ inch thick before compression and having a softness of less than 50 durometer.

4. The electric string instrument of claim 3, wherein the one or more soft pads has a durometer of less than 35.

5. The electric string instrument of claim 3, wherein a separate organic piezoelectric sensor is sandwiched between each bridge foot and an underlying soft pad.

6. The electric string instrument of claim 3, comprising a sensor between each bridge foot and an underlying soft pad, a stereo audio circuit that amplifies two such sensor outputs, a headphone output to a player of the instrument, and a stereo audio input to allow the player the option of adding other recorded music.

7. The electric string instrument of claim 3, further comprising a horizontal waist portion.

8. The electric string instrument of claim 3, further comprising a mount for a personal music device.

9. The wearable string instrument as described in claim 1, wherein the bridge has a mass of less than 15 grams.

10. An electric stringed instrument comprising at least 4 strings held by a bridge, the bridge having 2 feet with at least one foot mounted on soft material of less than 35 durometer and of at least 0.125 inch thickness before compression, and an organic vibration sensor sandwiched between the at least one foot and the soft material and connected to circuitry that allows detection of inter-string harmonic energy output.

11. The electric stringed instrument of claim 10, wherein the bridge has a height to width ratio of between 0.4 to 2.0.

12. The electric stringed instrument of claim 10, wherein the bridge width at the feet is less than the width at the bridge top.

13. The electric stringed instrument of claim 10, further comprising a horizontal waist portion.

14. The electric string instrument of claim 3, wherein the bridge has a weight of less than 15 grams.

15. A wearable electric stringed instrument comprising the stringed instrument of claim 1, and further comprising a horizontal waist portion that is vertically stiff to support the instrument when placed on a horizontal surface.

16. The electric stringed instrument of claim 1, further comprising a piezoelectric sensor under each bridge foot.

17. The electric stringed instrument of claim 16, further comprising a stereo circuit and headphone output.

18. The electric stringed instrument of claim 17, further comprising a stereo audio input to allow the player the option of adding other recorded music.

19. The electric stringed instrument of claim 2, further comprising a horizontal waist mount that is vertically stiff to support the instrument when placed on a horizontal surface.

20. A guitar that comprises the electric stringed instrument of claim 2 and a shoulder strap.

21. The guitar of claim 20, further comprising a headphone output.

22. The electric stringed instrument of claim 2, wherein the one or more piezoelectric sensors are organic.

* * * * *